US005403705A

United States Patent [19]

Tanaka et al.

[11] Patent Number: 5,403,705

[45] Date of Patent: Apr. 4, 1995

[54] SILVER HALIDE PHOTOGRAPHIC EMULSION AND LIGHT-SENSITIVE SILVER HALIDE PHOTOGRAPHIC MATERIAL

[75] Inventors: Shigeo Tanaka; Makoto Kaga; Tsuyoshi Ikeda, all of Hino, Japan

[73] Assignee: Konica Corporation, Japan

[21] Appl. No.: 127,788

[22] Filed: Sep. 28, 1993

[30] Foreign Application Priority Data

Oct. 13, 1992 [JP] Japan ..... 4-274522

[51] Int. Cl.[6] ..... G03C 1/08

[52] U.S. Cl. ..... 430/570; 430/517; 430/522; 430/546; 430/569; 430/581; 430/582; 430/583; 430/584; 430/585

[58] Field of Search ..... 430/569, 963, 546, 570, 430/522, 517, 581, 583–585

[56] References Cited

U.S. PATENT DOCUMENTS 3,565,633 2/1971 Klinger et al. ..... 96/114.7
5,173,395 12/1992 Asami ..... 430/37.6

FOREIGN PATENT DOCUMENTS 368229 5/1990 European Pat. Off. .
1338567 11/1973 United Kingdom .
1484479 9/1977 United Kingdom .
2194068 2/1988 United Kingdom .

OTHER PUBLICATIONS

Patent Abstracts of Japan, vol. 9 No. 269 (P-400)[1992]; Oct. 26, 1985 JPA-60-115,933; Jun. 22, 1985.

*Primary Examiner*—Thorl Chea
*Attorney, Agent, or Firm*—Jordan B. Bierman

[57] ABSTRACT

A light-sensitive silver halide photographic material is disclosed. The light-sensitive material comprises a support having thereon a silver halide emulsion layer, and the silver halide emulsion layer comprises silver halide grains having a silver chloride content of not less than 95 mol %. The emulsion is optically sensitized by addition of a dispersion of an optical sensitizer comprising a medium and particles of the dye dispersed in the medium. The ratio of silver to gelatin (Ag/Gel) in the emulsion at the time of addition of the dispersion of the dye is 2 to 8.5.

8 Claims, No Drawings

SILVER HALIDE PHOTOGRAPHIC EMULSION AND LIGHT-SENSITIVE SILVER HALIDE PHOTOGRAPHIC MATERIAL

FIELD OF THE INVENTION

The present invention relates to a silver halide photographic emulsion that can make it possible to stably obtain a high-quality image by short-time processing. More particularly, it relates to a light-sensitive silver halide photographic material having a superior storage stability prior to exposure, in particular, a superior storage stability in an environment of room temperature and high humidity, and also relates to a silver halide photographic emulsion used in the light-sensitive material.

BACKGROUND OF THE INVENTION

Light-sensitive silver halide photographic materials, in particular, light-sensitive silver halide color photographic materials have a high sensitivity and give an excellent gradation. Hence, they are nowadays in a very wide use.

However, light-sensitive silver halide color photographic materials are photographically processed by what is called wet processing, which has been involved in the disadvantages that it takes much time and labor for the preparation of processing solutions, pollutes surroundings, produces waste fluids containing various chemicals, requires darkrooms and takes a long time until a first print is obtained after start of operation. To offset such disadvantages and make the most of the light-sensitive silver halide color photographic materials, it has been widely established that skilled engineers handle the processing from the development of color negatives up to the preparation of color prints in a centralized system.

Meanwhile, although there are no fundamental changes in the wet processing, a series of improvements in machinery such as printers and automatic processors, improvements in photographic processing solutions and improvements in light-sensitive silver halide color photographic materials and forms for their packaging have recently brought about a rapid spread of what is called minilabs that can continuously operate the processing from the development of color negatives up to the preparation of color prints at a small place such as a storefront of photograph shops.

In particular, employment of silver halide emulsions containing silver chloride in a high concentration has made processing time remarkably shorter. However, the silver halide emulsions containing silver chloride in a high concentration are known to be inferior in the stability of performances during storage, and an advance has been made on techniques in which, e.g., a specific nitrogen-containing heterocyclic mercapto compound is used. None of conventional techniques, however, have achieved a satisfactory improvement, where, in particular, a decrease in sensitivity in an environment of room temperature and high humidity has been questioned.

It is hitherto well known to add a spectral sensitizer to a silver halide photographic emulsion in an undissolved state.

For example, Japanese Patent Publication Open to Public Inspection (hereinafter referred to as Japanese Patent O.P.I. Publication) No. 135437/1990 discloses that no flocculates can be caused and coating difficulties can be decreased by a technique in which a photographic additive having a good dispersibility in water is added in water, followed by dispersion using a dispersion machine, and thereafter a photographic additive substantially insoluble in the resulting dispersion and having a high solubility in a surface active agent is added together with a surface active agent having a sulfonic acid group or sulfate group as a hydrophilic group, to give a dispersion, which is then added to a silver halide emulsion. Similarly, Japanese Patent O.P.I. Publications No. 135438/990, No. 23331/1990 and No. 23332/1990 disclose methods in which a dispersion of a photographic additive is obtained using a surface active agent. None of them, however, have any specific disclosure as to photographic performances.

Japanese Patent O.P.I. Publication No. 23330/1990 also discloses that coating difficulties can be decreased by a method in which a water-insoluble photographic additive is heated and dissolved using an organic solvent together with at least one readily water-soluble photographic additive until they completely dissolve, followed by evaporation of the organic solvent from the resulting solution to give a flaky concentrate, thereafter the flaky concentrate is dispersed in water, and then the resulting dispersion is added to a silver halide emulsion. This publication, however, is also silent as to photographic performances.

Japanese Patent O.P.I. Publication No. 196749/1985 discloses that an increase in the rate of development and an improvement in the prevention of reciprocal law failure can be achieved by adding a spectral sensitizer without use of any organic solvent, before the formation of silver halide grains is completed. Japanese Patent O.P.I. Publication No. 105141/1983 also discloses that the desired sensitivity can be achieved and no coating difficulties can be made to occur by the use of a dispersion obtained by mechanically pulverizing a spectral sensitizer into fine particles of 1 μm or smaller in an aqueous system to effect dispersion, under conditions of pH 6 to 8 and 60° to 80° C. In Examples thereof, it is disclosed to use a dispersion prepared by dispersing a spectral sensitizer using a high-speed stirrer. However, the silver halide photographic emulsion used therein is a pure silver bromide or silver iodobromide emulsion or a silver chlorobromide emulsion containing silver bromide in a high content, and there is neither disclosure nor suggestion as to performances questioned when a solid dispersion of a spectral sensitizer is used in a silver chlorobromide emulsion containing silver chloride in a high content or a pure silver chloride emulsion. Similar techniques are also disclosed in Japanese Patent O.P.I. Publications No. 125631/1992, No. 125632/1992, No. 125634/1992, etc. These publications also have neither disclosure nor suggestion as to the disadvantage originating from the silver chlorobromide emulsion containing silver chloride in a high content or the pure silver chloride emulsion and as to the performances questioned when a solid dispersion of a spectral sensitizer is used in these emulsions.

Japanese Patent O.P.I. Publications No. 80119/1975 and No. 80826/1975 disclose that a high sensitivity can be achieved by a method in which a substantially water-insoluble photographic additive is dissolved in an acid having pKa not more than 5, the resulting solution is dispersed in a water-based solution, and the resulting dispersion is added to a silver halide photographic emulsion. However, the halogen composition of the silver halide photographic emulsion specifically described therein is silver chlorobromide mainly composed of silver bromide, and there is neither disclosure nor suggestion as to the performances questioned when a solid dispersion of a spectral sensitizer is used in the silver chlorobromide emulsion containing silver chloride in a high content or the pure silver chloride emulsion. In addition, the weight ratio of silver halide (in terms of silver) to gelatin (Ag/Gel) at the time of spectral sensitization is 1 or less, and there is no disclosure as to the effect of the present invention obtained when a chloride-rich silver halide emulsion is spectrally sensitized under a specific ratio of silver halide to gelatin.

SUMMARY OF THE INVENTION

To cope with the problems discussed above, an object of the present invention is to provide a light-sensitive silver halide photographic material that can stably obtain a high-quality image by short-time processing, and a silver halide photographic emulsion used in the light-sensitive material, and more particularly to provide a light-sensitive silver halide photographic material having a superior storage stability prior to exposure, in particular, a superior storage stability in an environment of room temperature and high humidity.

The light-sensitive of the present invention comprises a support having thereon a silver halide emulsion layer. The silver halide emulsion comprises silver halide grains having a silver chloride content of not less than 95 mol% and gelatin. The emulsion is optically sensitized by addition of a dispersion of an optical sensitizer comprising a medium and solid particles of the dye dispersed in the medium and the emulsion has a ratio of silver to gelatin (Ag/Gel) of 2 to 8.5 at the time of addition of the dispersion of the dye.

In a preferable embodiment of the invention, the emulsion layer or another layer provided on the surface of the support on which said emulsion layer is provided contains a compound represented by Formula AI.

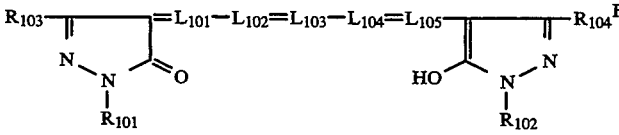

Formula AI wherein $L_{101}$, $L_{102}$, $L_{103}$, $L_{104}$ and $L_{105}$ each represent a methine group; $R_{101}$ and $R_{102}$ each represent an aralkyl group, an aryl group or a heterocyclic group; and $R_{103}$ and $R_{104}$ each represent a monovalent organic group.

DETAILED DESCRIPTION OF THE INVENTION

The silver halide photographic emulsion according to the present invention is characterized by containing 95 mol% or more of silver chloride. A silver halide emulsion containing 95 mol% or more, and more preferably from 98 to 99.9 mol%, of silver chloride is preferred. The constituent other than the silver chloride may include silver bromide and silver iodide, and may preferably be silver bromide containing substantially no silver iodide.

The silver halide emulsion according to the present invention may be one which has a portion containing silver bromide in a high content, and such an emulsion is preferred. In this case, the portion having silver bromide in a high content may be epitaxially joined to a silver halide emulsion grain, may be in the form of what is called a core-shell structure, or may only be present as a region merely compositionally different in part without formation of a complete layer. Its composition may be continuously changed or discontinuously changed. The portion where the silver bromide is present in a high content may be present either at the surface of a silver halide grain or in the inside thereof.

Heavy metal ions may be contained in the silver halide grains according to the present invention. Such compounds are useful for preventing reciprocal law failure. Heavy metal ions that can be used for such purpose may include ions of Group VIII metals such as iron, iridium, platinum, palladium, nickel, rhodium, osmium, ruthenium and cobalt, Group II transition metals such as cadmium, zinc and mercury, rhenium, molybdenum, tungsten, and chromium. In particular, ions of transition metals such as iron, iridium, platinum, ruthenium and osmium are preferred.

These metal ions may be added to the silver halide emulsion in the form of a salt or complex. In particular, they may preferably be added to the emulsion in the form of a complex since they can be more readily incorporated into the silver halide emulsion and the present invention can be more effective.

In the case when the heavy metal ion forms a complex, its ligand may include cyanide ions, thiocyanate ions, cyanate ions, chloride ions, bromide ions, iodide ions, carbonyl ions and ammonium ions. In particular, cyanide ions, thiocyanate ions, isothiocyanide ions and cyanate ions are preferred.

Heavy metal compounds preferably usable in the silver halide emulsion according to the present invention are shown below. In the present invention, the compounds are by no means limited to these.

| | | | |
|---|---|---|---|
| (1) | $FeCl_2$ | (2) | $FeCl_3$ |
| (3) | $(NH_4)Fe(SO_4)_2$ | (4) | $K_3[Fe(CN)_6]$ |
| (5) | $K_4[Fe(CN)_6]$ | (6) | $K_2[IrCl_6]$ |
| (7) | $K_3[IrCl_6]$ | (8) | $K_2[PtCl_6]$ |
| (9) | $K_2[Pt(SCN)_4]$ | (10) | $K_2[NiCl_4]$ |
| (11) | $K_2[PdCl_6]$ | (12) | $K_3[RdCl_6]$ |
| (13) | $CdCl_2$ | (14) | $ZnCl_2$ |
| (15) | $K_2[Mo(CO)_4(CNO)_2]$ | (16) | $K_3(Re(CNO)_6]$ |
| (17) | $K_3[Mo(OCN)_6]$ | (18) | $K_4[Fe(CNO)_6]$ |
| (19) | $K_2[W(CO)_4(CNO)_2]$ | (20) | $K_2[Cr(CO)_4(CNO)_2]$ |
| (21) | $K_4[Ru(CNO)_6]$ | (22) | $K_2[Ni(CN)_4]$ |
| (23) | $PbCL_2$ | (24) | $K_3[CO(NH_3)_6]$ |
| (25) | $K_5[Co(CNO)_{11}]$ | (26) | $K_3[Re(CNO)_6]$ |
| (27) | $K_4[Os(CNO)_6]$ | (28) | $K_2[Cd(CNO)_4]$ |
| (29) | $K_2[Pt(CNO)_4]$ | (30) | $K_3[IrBr_6]$ |

In order to incorporate the heavy metal ions into the silver halide grains according to the present invention, the heavy metal compound may be added at any stage of the steps before the formation of silver halide grains, during the formation of silver halide grains, and during physical ripening after the formation of silver halide grains. In order to obtain the silver halide emulsion that satisfies the condition described above, it is advantageous to dissolve the heavy metal compound together with a halide salt and continuously add the solution through the whole or part of the step of forming grains.

When the heavy metal ions are added to the silver halide emulsion, they may preferably be in an amount of from not less than $1\times10^{-9}$ to not more than $1\times10^{-2}$ mol, and particularly preferably from not less than $1\times10^{-8}$ to not more than $1\times10^{-5}$ mol, per mol of silver halide.

The silver halide grains according to the present invention may have any form. A preferable example is a cube having (100) plane as a crystal surface. Grains having the form of octahedrons, tetradecahedrons, dodecahedrons or the like may be prepared by the method disclosed in U.S. Pat. No. 4,183,756 and U.S. Pat. No. 4,225,666, Japanese Patent O.P.I. Publication No. 26589/1980, Japanese Patent Examined Publication No. 42737/1980 or The Journal of The Photographic Science (J. Photogr. Sci.) 21, 39 (1973), and such grains may be used. Grains having twin planes may also be used.

The silver halide grain according to the present invention may be grains having simple shapes or a mixture of grains having various shapes, any of which may be used.

There are no particular limitations on the grain size of the silver halide grain according to the present invention. Taking account of rapid processability, sensitivity and other photographic performances, the grain size may preferably be in the range of from 0.1 to 1.2 μm, and more preferably from 0.2 to 1.0 μm. The grain size can be measured by various methods commonly used in the present technical field. A typical method include the method disclosed in Loveland, Particle-Size Analytical Method, ASTM Symposium on Light Microscopy, pages 94–122, 1955, or Mees and James, The Theory of The Photographic Process, Third Edition, Chapter 2, Macmillan Publishing Co., Inc., 1966.

This grain size can be measured using projected areas of grains or approximate values of diameters. In the case when the grains are substantially uniform in their shapes, grain size distribution can be reasonably accurately expressed as diameters or projected areas.

The distribution of grain size of the silver halide grains according to the present invention may be either polydisperse or monodisperse. Preferred are monodisperse silver halide grains having a coefficient of size distribution variation of 0.22 or less, and more preferred are those of 0.15 or less. Here, the coefficient of variation is a coefficient that represents the breadth of grain size distribution, and is defined by the following expression.

Coefficient of variation = S/R wherein S represents a standard deviation of grain size distribution, and R represents an average grain size.

The grain size herein referred to indicates a diameter of a grain when it is a spherical silver halide grain or, when it is a grain having the shape other than that of a cube or sphere, a diameter obtained by calculating its projected image into a circular image having the same area.

The silver halide emulsion can be prepared using various apparatus and methods known in the present industrial field.

The silver halide emulsion according to the present invention may be obtained by any of the acidic method, the neutral method and the ammoniacal method. The grains may be grown at one time, or may be grown after seed grains have been produced. The manner by which the seed grains are produced and the manner by which grains are grown may be the same or different.

The mode in which a soluble silver salt and a soluble halide salt are allowed to react may be any of normal precipitation, reverse precipitation, double-jet precipitation, and combinations of these. Emulsions obtained by double-jet precipitation are preferred. As a mode of the double-jet precipitation, the pAg-controlled double-jet precipitation as disclosed in Japanese Patent O.P.I. Publication No. 48521/1979 may also be used.

It is also possible to use an apparatus for feeding an aqueous solution of a water-soluble silver salt and an aqueous solution of a water-soluble halide salt from an addition apparatus provided in reaction mother liquor, as disclosed in Japanese Patent O.P.I. Publications No. 92523/1982 and No. 92524/1982; an apparatus for adding aqueous solutions of a water-soluble silver salt and a water-soluble halide salt while continuously changing their concentrations, as disclosed in German Patent Publication No. 29 21 164; and an apparatus for forming grains while keeping the distance between silver halide grains constant, by taking out mother liquor outside a reaction vessel and concentrating it by ultrafiltration, as disclosed in Japanese Patent Examined Publication No. 501776/1981.

If necessary, a silver halide solvent such as thioether may also be used. Also, a compound having a mercapto group, a nitrogen-containing heterocyclic compound or a compound such as a spectral sensitizer may be used by adding them when silver halide grain are formed or after the formation of grains has been completed.

The silver halide emulsion according to the present invention may be sensitized by a method making use of a gold compound or a method making use of a chalcogen sensitizer, which may be used in combination.

As the chalcogen sensitizer used in the silver halide emulsion according to the present invention, a sulfur sensitizer, a selenium sensitizer and a tellurium sensitizer may be used. A sulfur sensitizer is preferred. The sulfur sensitizer may include thiosulfates, allylthiocarbamidothioureas, allyl isocyanates, cystine, p-toluenethiosulfonates, rhodanine and elemental sulfur.

The amount in which the sulfur sensitizer according to the present invention may preferably be varied depending on the type of the silver halide emulsion used and the magnitude of the effect to be expected. It may preferably be in the range of from $5\times10^{-10}$ to $5\times10^{-5}$ mol, and more preferably from $5\times10^{-8}$ to $3\times10^{-5}$ mol, per mol of silver halide.

As a gold sensitizer according to the present invention, it may be added in the form of various gold complexes such as chloroauric acid and gold sulfide. A ligand compound used may include dimethyl rhodanine, thiocyanic acid, mercaptotetrazole and mercaptotriazole. Use of the gold compound under such a condition that these ligand compounds act as sulfur sensitizers is not preferable. The amount of the gold compound used can not be uniform depending on the type of the compound used and the ripening conditions. In usual instances, it may preferably be in the range of from $1\times10^{-4}$ mol to $1\times10^{-8}$ mol per mol of silver halide. It may more preferably be in the range of from $1\times10^{-5}$ mol to $1\times10^{-8}$ mol.

The silver halide emulsion according to the present invention may be chemically sensitized by reduction sensitization, which is particularly preferably used.

The silver halide emulsion according to the present invention may be subjected to the reduction sensitization by using known methods. For example, it is possible to use a method in which various reducing agents are added, a method in which ripening is carried out under conditions of a high silver ion concentration, or a method in which ripening is carried out under conditions of a high pH.

The reducing agent used in the reduction sensitization of the silver halide emulsion according to the present invention may include stannous salts such as stannous chloride, boranes such as tri-t-butylamineborane, sulfites such as sodium sulfite and potassium sulfite, reductones such as ascorbic acid, and thiourea dioxide. Of these, compounds preferably usable may include thiourea dioxide, ascorbic acid and derivatives thereof, and sulfites. Compared with the case when reduction sensitization is carried out while controlling silver ion concentration and pH during the ripening, the method making use of a reducing agent as described above has a superior reproducibility and hence is preferred.

Any of these reducing agents may be added in the silver halide emulsion after it has been dissolved in a solvent such as water or alcohol, to carry out ripening. Alternatively, it may be added when silver halide grains are formed, to carry out reduction sensitization simultaneously with the formation of grains.

The amount of the reducing agent added must be adjusted in accordance with the pH of the silver halide emulsion, the concentration of silver ions and so forth. In usual instances, it may preferably be in a range of from $10^{-7}$ to $10^{-2}$ mol per mol of the silver halide emulsion.

An oxidizing agent may be used in a small amount so that reduction-sensitizing nuclei can be modified after the reduction sensitization or any remaining reducing agent can be deactivated. Compounds used for such purpose may include potassium ferric hexacyanate, bromosuccinimide, p-quinone, potassium perchlorate and hydrogen peroxide.

In the silver halide emulsion according to the present invention, known antifoggants and stabilizers may be used for the purposes of preventing fog from occurring in the course of the preparation of the light-sensitive silver halide photographic material, decreasing variations in performances during storage and preventing fog from occurring at the time of development. Compounds that can be used for such purpose can be exemplified by compounds represented by Formula II disclosed in Japanese Patent O.P.I. Publication No. 146036/1990, page 7, lower column. Specific compounds thereof may include compounds IIa-1 to IIa-8 and IIb-1 to IIb-7 disclosed in the same publication, page 8. Depending on the purpose, these compounds may be added in the step of preparing silver halide emulsion grains, in the step of chemical sensitization, at the time when the step of chemical sensitizerion is completed, or in the step of preparing coating solutions. In the case when chemical sensitization is carried out in the presence of such a compound, the compound may preferably be used in an amount of about $1\times10^{-5}$ mol to about $5\times10^{-4}$ mol per mol of silver halide. In the case when the compound is added at the time when chemical sensitization is completed, it may preferably be in an amount of from about $1\times10^{-6}$ mol to about $1\times10^{-2}$ mol, and more preferably from $1\times10^{-5}$ mol to $5\times10^{-3}$ mol, per mol of silver halide. In the case when the compound is added to silver halide emulsion layers in the step of preparing coating solutions, it may preferably be in an amount of from about $1\times10^{-6}$ mol to about $1\times10^{-1}$ mol, and more preferably from $1\times10^{-5}$ mol to $1\times10^{-2}$ mol, per mol of silver halide. In the case when the compound is added to layers other than the silver halide emulsion layers, it may preferably be in an amount of from about $1\times10^{-9}$ mol to about $1\times10^{-3}$ mol as its amount in a coating layer.

The light-sensitive silver halide photographic material according to the present invention can be particularly greatly effective when it is in the presence of a specific anti-irradiation dye, and this is preferable. A preferable dye may include the compound of Formula AI previously set out. The lowering in sensitivity of the light-sensitive material caused by storage in a high humidity and high temperature condition can be effectively prevented by the presence of the compound of Formula AI.

In the formula, $R_{101}$ and $R_{102}$ each represent an aralkyl group, an aryl group or a heterocyclic group. The aralkyl group represented by $R_{101}$ and $R_{102}$ can be exemplified by a benzyl group or a phenethyl group, the aryl group can be exemplified by a phenyl group or a naphthyl group, and the heterocyclic group can be exemplified by a benzothiazolyl group, a pyridyl group, a pyrimidyl group or a tetrahydrothiophene-1,1-dioxide-3-yl group. The aralkyl group and the aryl group are preferred.

The aralkyl group, aryl group and heterocyclic group represented by $R_{101}$ and $R_{102}$ may each have a substituent of various types, which may include, for example, groups such as a sulfo group, a carboxyl group, a hydroxyl group, a cyano group, a halogen atom as exemplified by a fluorine atom or a chlorine atom, an alkyl group as exemplified by a methyl group, an ethyl group, an i-propyl group, a trifluoromethyl group, a t-butyl group, an ethoxycarbonylmethyl group or a sulfomethyl group, an amino group as exemplified by an amino group, a dimethylamino group, a sulfoethylamino group, a piperidino group or a morpholino group, an alkoxyl group as exemplified by a methoxyl group, an ethoxyl group or a sulfopropoxyl group, a sulfonyl group as exemplified by a methanesulfonyl group or an ethanesulfonyl group, a sulfamoyl group as exemplified by a sulfamoyl group or a dimethylsulfamoyl group, an acylamino group as exemplified by an acetamido group, a benzamido group or a sulfobenzamido group, a carbamoyl group as exemplified by a carbamoyl group, a phenylcarbamoyl group or a sulfophenylcarbamoyl group, a sulfonamido group as exemplified by a methanesulfonamido group or a benzenesulfonamido group, an alkoxycarbonyl group as exemplified by an ethoxycarbonyl group, a hydroxyethoxycarbonyl group or a benzyloxyecarbonyl group, and an aryloxycarbonyl group as exemplified by a phenoxycarbonyl group or a nitrophenoxycarbonyl group.

The aralkyl group and aryl group represented by $R_{101}$ and R should each preferably have on the aromatic ring thereof at least one group of a sulfo group, a carboxyl group and a phosphoric acid group, and more preferably have at least one sulfo group.

In the formula, $R_{103}$ and $R_{104}$ each preferably represent an alkyl group, an aryl group, an aralkyl group, a heterocyclic group, a carboxyl group, an alkoxycarbonyl group, an aryloxycarbonyl group, a carbamoyl group, a ureido group, a thioureido group, an acylamino group, an acyl group, an imido group, a cyano group, a hydroxyl group, an alkoxyl group and an amino group.

Examples of the alkyl group, alkoxycarbonyl group, aryloxycarbonyl group, carbamoyl group, acylamino group, alkoxyl group and amino group represented by $R_{103}$ and $R_{104}$ can be the same examples as those of the substituent that may be introduced into the aralkyl group, aryl group and heterocyclic group represented by $R_{101}$ and $R_{102}$.

The aryl group represented by $R_{103}$ and $R_{104}$ can be exemplified by a phenyl group, a sulfopropoxyphenyl group, a cyanophenyl group, a carboxyphenyl group, a nitrophenyl group or a sulfophenyl group, the aralkyl group can be exemplified by a benzyl group, a phenethyl group or a sulfobenzyl group, the heterocyclic can be exemplified by a furyl group or a thienyl group, the ureido group can be exemplified by a methylureido group or a phenylureido group, the thioureido group can be exemplified by a methylthioureido group or a phenylthioureido group, the imido group can be exemplified by a succinimido group or a phthalimido group, and the acyl group can be exemplified by an acetyl group or a pivalyl group.

The groups represented by $R_{103}$ and $R_{104}$ may each more preferably be a substituent having a Hammet's $\sigma p$ value of 0.3 or more in view of the prevention of residual-color stain, and most preferably be —CN, —CF($R_{105}$)($R_{106}$), —COO$R_{107}$ or —CON($R_{108}$)($R_{109}$), wherein $R_{105}$ and $R_{106}$ each represent a hydrogen atom, a fluorine atom or a fluorinated alkyl group having 1 to 4 carbon atoms, $R_{107}$ represents an alkyl group, an aryl group or a heterocyclic group, and $R_{108}$and $R_{109}$each represent a hydrogen atom, an alkyl group, an aryl group or a heterocyclic group. The groups represented by $R_{105}$, $R_{106}$, $R_{107}$, $R_{108}$ and $R_{109}$ may each further have a substituent.

Typical examples of the compound represented by Formula AI are shown below.

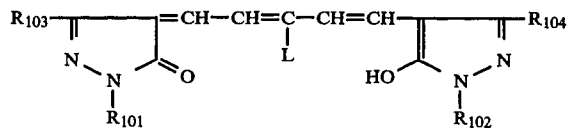
| No. | $R_{103}$ | $R_{104}$ | L | $R_{101}$ | $R_{102}$ |
|---|---|---|---|---|---|
| AI-1 | $-CONH(CH_2)_2OH$ | $-CONH(CH_2)_2OH$ | H | 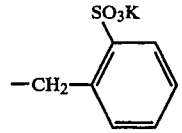 | 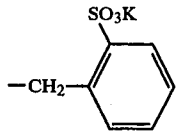 |
| AI-2 | $-CONH(CH_2)_2OH$ | $-CONH(CH_2)_2OH$ | H | 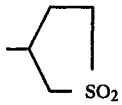 | 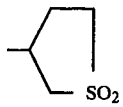 |
| AI-3 | $-COOH$ | $-COOH$ | H | 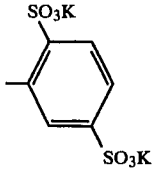 | 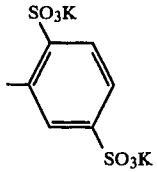 |
| AI-4 | $-CN$ | $-CN$ | H | 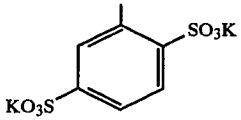 | 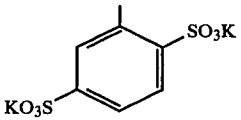 |
| AI-5 | $-CN$ | $-CN$ | H | 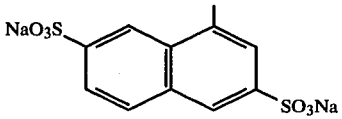 | 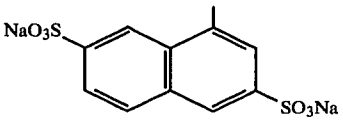 |
| AI-6 | $-CF_3$ | $-CF_3$ | H | 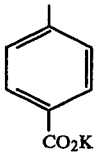 | 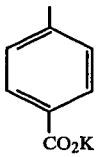 |

-continued
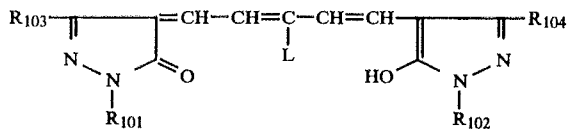
| No. | $R_{103}$ | $R_{104}$ | L | $R_{101}$ | $R_{102}$ |
|---|---|---|---|---|---|
| AI-7 | 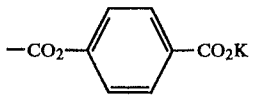 | 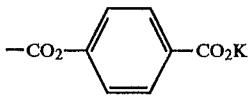 | H | 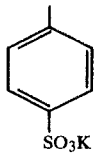 | 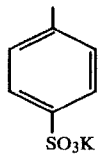 |
| AI-8 | $-CO_2C_2H_5$ | $-CO_2C_2H_5$ | $-CH_3$ | 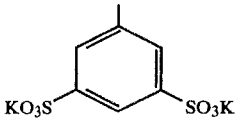 | 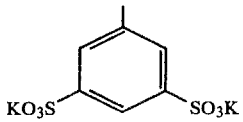 |
| AI-9 | $-CONH_2$ | $-CONH_2$ | H | 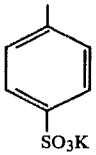 | 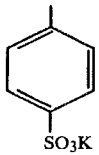 |
| AI-10 | $-CONH_2$ | $-CONH_2$ | H | 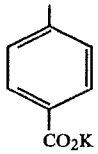 | 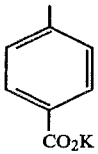 |
| AI-11 | $-CONHCF_3$ | $-CONHCF_3$ | H | 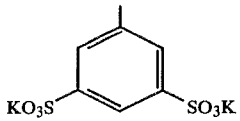 | 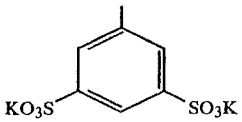 |

-continued
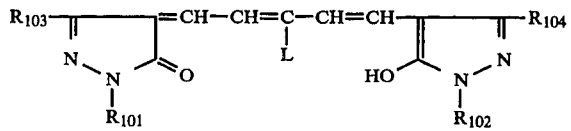
| No. | $R_{103}$ | $R_{104}$ | L | $R_{101}$ | $R_{102}$ |
|---|---|---|---|---|---|
| AI-12 | $-COCH_3$ | $-COCH_3$ | H | 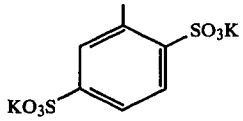 | 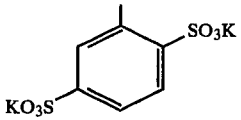 |
| AI-13 | $-CN$ | $-CN$ | H | 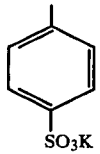 | 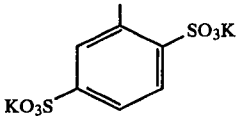 |
| AI-14 | $-COCH_3$ | $-COCH_3$ | H | 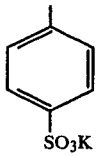 | 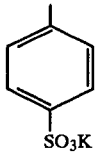 |
| AI-15 | 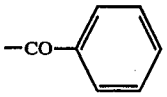 | 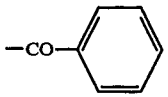 | H | 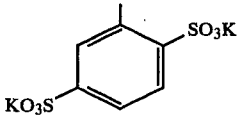 | 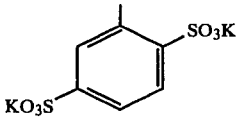 |
| AI-16 | $-CO_2C_2H_5$ | $-CO_2C_2H_5$ | H | 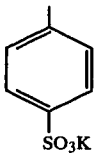 | 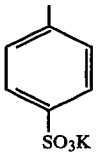 |

-continued
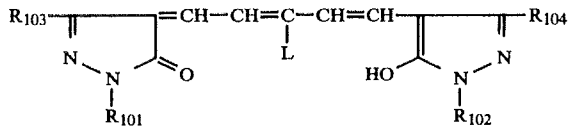
| No. | $R_{103}$ | $R_{104}$ | L | $R_{101}$ | $R_{102}$ |
|---|---|---|---|---|---|
| AI-17 | $-CO_2C_2H_5$ | $-CO_2C_2H_5$ | H | 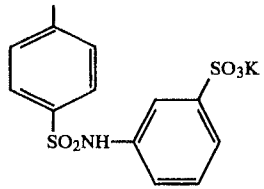 | 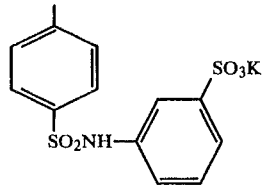 |
| AI-18 | $-CN$ | $-CN$ | H | 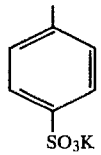 | 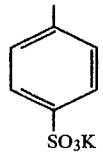 |
| AI-19 | $-CO_2C_2H_5$ | $-CO_2C_2H_5$ | H | 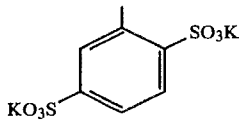 | 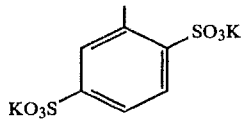 |

Besides the above compounds, the compound of Formula AI may also include exemplary compounds 47 to 57, 60 to 67 and 69 to 85 disclosed in Japanese Patent O.P.I. Publication No. 26850/1989, pages 9–11.

The compound of Formula AI can be synthesized by the method disclosed in Japanese Patent O.P.I. Publications No. 26850/1989 and No. 143245/1990.

In instances in which infrared-sensitive emulsions are used, compounds represented by Formulas I, II and III disclosed in Japanese Patent O.P.I. Publication No. 280750/1989, page 2, left lower column, are preferable as infrared absorptive dyes since they have preferable spectral characteristics, have no influence on the photographic performances of silver halide photographic emulsions and may cause no stain due to residual colors. Examples of preferable compounds are exemplary compounds 1 to 45 disclosed in the same publication, page 3, left lower column to page 5, left lower column.

In the case when the light-sensitive silver halide photographic material according to the present invention is used as a color photographic material, it has layers containing silver halide emulsions spectrally sensitized to specific regions of wavelength regions of from 400 to 900 nm in combination of a yellow coupler, a magenta coupler and a cyan coupler. Such silver halide emulsions contain one kind or two or more kinds of spectral sensitizers in combination.

With regard to the spectral sensitizers according to the present invention, any known compounds can be preferably used. Preferable compounds may include the following compounds.

Formula SPS-I

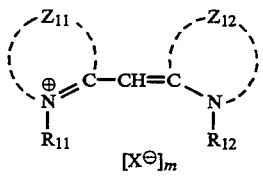

$Z_{11}$ and $Z_{12}$ each represent a group of atoms necessary to form an oxazole nucleus, a thiazole nucleus, a selenazole nucleus, a pyridine nucleus, a benzoxazole nucleus, a benzothiazole nucleus, a benzoselenazole nucleus, a benzoimidazole nucleus, a naphthoxazole nucleus, a naphthothiazole nucleus, a naphthoselenazole nucleus, a naphthoimidazole nucleus or a quinoline nucleus.

$R_{11}$ and $R_{12}$ each represent an alkyl group, an alkenyl group or an aryl group.

X represents an anion, and m represents 0 or 1.

In Formula SPS-I, the heterocyclic nucleus represented by $Z_{11}$ and $Z_{12}$ may preferably be a thiazole nucleus, a selenazole nucleus, a benzothiazole nucleus, a benzoselenazole nucleus or a naphthothiazole nucleus, and more preferably be a benzoselenazole nucleus or a naphthothiazole nucleus.

The heterocyclic nucleus represented by $Z_{11}$ and $Z_{12}$ may have a substituent. A preferable substituent may include a halogen atom, a hydroxyl group, a cyano group, an aryl group, an alkyl group and an alkoxyl group.

Of the halogen atom, a chlorine atom is particularly preferred. The aryl group may preferably be a phenyl group.

The alkyl group may preferably be a straight-chain or branched alkyl group having 1 to 4 carbon atoms, including groups such as methyl, ethyl, propyl, i-propyl and butyl. In particular, a methyl group is preferred.

The alkoxyl group may preferably be an alkoxyl group having 1 to 4 carbon atoms, including groups such as methoxyl, ethoxyl or propxyl. In particular, a methoxyl group is preferred.

The alkyl group represented by $Z_{11}$ and $Z_{12}$ may preferably be a straight-chain or branched alkyl group having 1 to 6 carbon atoms, including groups such as methyl, ethyl, propyl and i-propyl. These alkyl groups may have a substituent. A preferable substituent includes a sulfo group, a carboxyl group, a hydroxyl group, an alkoxycarbonyl group and an alkylsulfonylamino group.

The substituted alkyl group specifically includes groups such as 2-sulfoethyl, 3-sulfopropyl, 4-sulfobutyl, 3-sulfobutyl, carboxymethyl, 2-carboxyethyl, 2-ethoxycarbonylethyl, 2-hydroxyethyl and 2-methylsulfonylaminoethyl.

The alkyl group represented by $Z_{11}$ and Z12 may preferably be an alkyl group substituted with a sulfo group or a carboxyl group.

The sulfo group and the carboxyl group may form a salt together with an organic cation such as a pyridinium ion or a triethylammonium ion or an inorganic cation such as an ammonium ion, a sodium ion or a potassium ion.

The anion represented by X may preferably be a chloride ion, a bromide ion, an iodide ion or a p-toluenesulfonate ion. A halide ion is preferred.

When it forms an intramolecular salt, no anion may be contained. In such a case, m represents 0 or 1.

Formula SPS-II

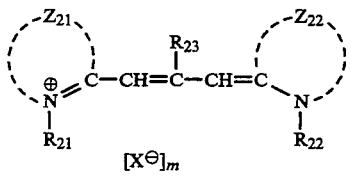

$Z_{21}$ and $Z_{22}$ each represent a group of atoms necessary to form an oxazole nucleus, a thiazole nucleus, a selenazole nucleus, a pyridine nucleus, a benzoxazole nucleus, a benzothiazole nucleus, a benzoselenazole nucleus, a benzoimidazole nucleus, a naphthoxazole nucleus, a naphthothiazole nucleus, a naphthoselenazole nucleus, a naphthoimidazole nucleus or a quinoline nucleus.

$R_{21}$ and $R_{22}$ each represent the same as $R_{11}$ and $R_{12}$ in Formula SPS-I. X and m represent the same as X and m in Formula SPS-I.

$R_{23}$ represents a hydrogen atom, an alkyl group or an aryl group.

The heterocyclic nucleus represented by $Z_{21}$ and $Z_{22}$ may preferably be a benzothiazole nucleus, a benzoselenazole nucleus, a benzoxazole nucleus, a benzoimidazole nucleus, a naphthothiazole nucleus, a naphthoxazole nucleus, a naphthoselenazole nucleus or a naphthoimidazole nucleus. The heterocyclic group represented by $Z_{21}$ and $Z_{22}$ may have a substituent. A preferable substituent may include the same groups as described for $Z_{11}$ and $Z_{12}$ in Formula SPS-I.

The alkyl group represented by $R_{23}$ may preferably be an ethyl group or a propyl group, and the aryl group may preferably be a phenyl group.

Formula SPS-III

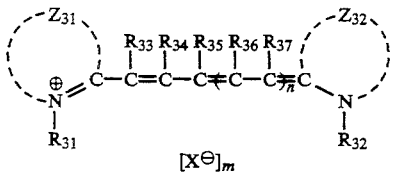

$Z_{31}$ and $Z_{32}$ each represent a group of atoms necessary to form a benzoxazole nucleus, a benzothiazole nucleus, a benzoselenazole nucleus, a naphthoxazole nucleus, a naphthothiazole nucleus, a naphthoselenazole nucleus or a quinoline nucleus.

$R_{31}$ and $R_{32}$ each represent the same as $R_{11}$ and $R_{12}$ in Formula SPS-I. X and m represent the same as X and m in Formula SPS-I. n represents 1 or 2.

$R_{33}$, $R_{34}$, $R_{35}$, $R_{36}$ and $R_{37}$ each represent a hydrogen atom, an alkyl group or an aryl group. When n represents 2, $R_{36}$ and $R_{37}$ may be the same or different.

The heterocyclic nucleus represented by $Z_{31}$ and $Z_{32}$ may preferably be a benzothiazole nucleus, a benzoselenazole nucleus, a benzoxazole nucleus, a a naphthothiazole nucleus, a naphthoxazole nucleus or a quinoline nucleus. The heterocyclic group represented by $Z_{31}$ and $Z_{32}$ may have a substituent. A preferable substituent may include the same groups as described for $Z_{11}$ and $Z_{12}$ in Formula SPS-I.

The alkyl group represented by $R_{33}$ to $R_{37}$ may preferably be a methyl group or an ethyl group, and $R_{34}$ and $R_{36}$ may combine to form a ring.

The above compounds are known in the art, and can be readily synthesized by, for example, the method disclosed in Harmer, The Cyanine Dyes and Related Compounds, Interscience Publishers, Inc., New York, 1969.

The spectral sensitizer used in the present invention, though variable depending on the types of the spectral sensitizer, the halogen composition and grain size of the silver halide emulsion applied, etc. may preferably be used in an amount ranging from $5\times10^{-5}$ to $2\times10^{-3}$ mol, and more preferably from $1\times10^{-4}$ to $7\times10^{-4}$ mol, per mol of silver halide.

The spectral sensitizer may be added at any time in the course of from the formation of silver halide grains up to the completion of chemical sensitization.

The spectral sensitizer may be dispersed by using a method in which using a high-speed stirring dispersion machine the spectral sensitizer is mechanically pulverized into fine particles of 1 μm or smaller in an aqueous system to effect dispersion, besides, a method in which the spectral sensitizer is mechanically pulverized into fine particles of 1 μm or smaller in an aqueous system to effect dispersion, under conditions of pH 6 to 8 and 60° to 80° C., as disclosed in Japanese Patent O.P.I. Publication No. 105141/1983, or a method in which the spectral sensitizer is dispersed in the presence of a surface active agent capable of controlling surface tension to be 38 dyne/cm or below, as disclosed in Japanese Patent Examined Publication No. 6496/1985. It is particularly preferred that the dye is mechanically dispersed in water without any surface active agent. The particle size of dispersed dye is preferably within the range of from 10 nm to 900 nm, and particularly from 100 to 800 nm, even though the size may be changed depending on the kind or solubility of the dye.

The dispersion apparatus that can be used in the preparation of dispersions may include, for example, the high-speed stirring dispersion machine disclosed in Japanese Patent O.P.I. Publication No. 125631/1992, as well as a ball mill, a sand mill and an ultrasonic dispersion machine.

When these dispersion apparatus are used, wet process dispersion may be carried out after pretreatment such as dry process pulverization has been applied as disclosed in Japanese Patent O.P.I. Publication No. 125632/1992. Such a method may be employed.

The spectral sensitizer according to the present invention may be used in combination with a plurality of spectral sensitizers so long as the effect of the present invention is not damaged. In such a case, two types of spectral sensitizers may be separately added to the silver halide emulsion, or may be added thereto after they are previously mixed.

Typical examples of the spectral sensitizers represented by Formulas SPS-I, SPS-II and SPS-III are shown below. In the present invention, examples are by no means limited to these.

SPS-I-1

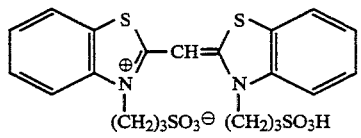

SPS-I-2

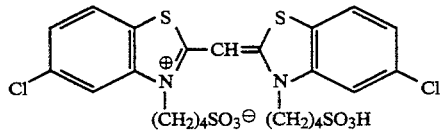

SPS-I-3

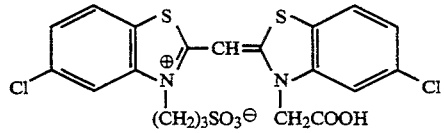

-continued
SPS-I-4
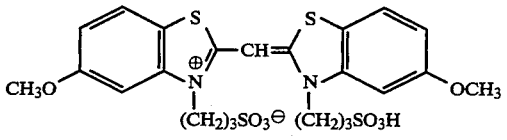
SPS-I-5
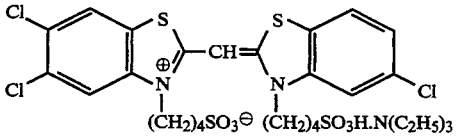
SPS-I-6
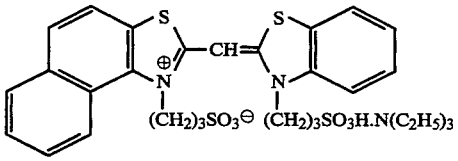
SPS-I-7
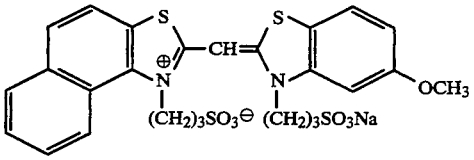
SPS-I-8
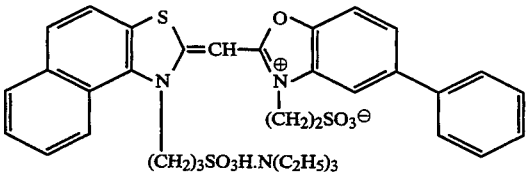
SPS-I-9
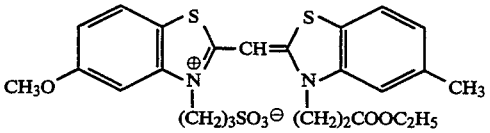
SPS-I-10
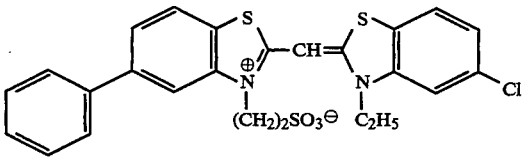
SPS-I-11
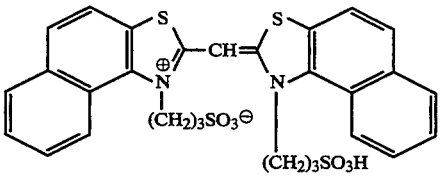
SPS-I-12
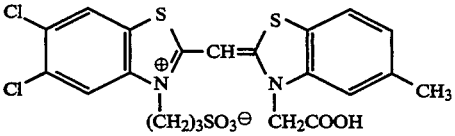

-continued
SPS-I-13
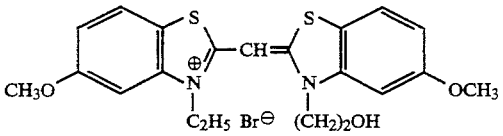
SPS-I-14
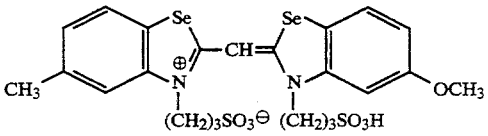
SPS-I-15
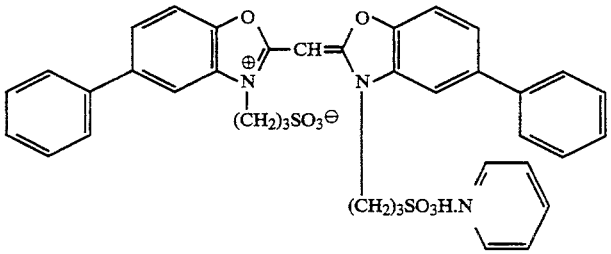
SPS-I-16
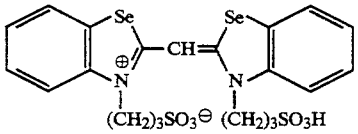
SPS-I-17
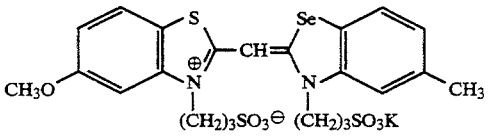
SPS-I-18
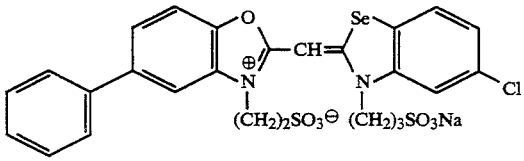
SPS-I-19
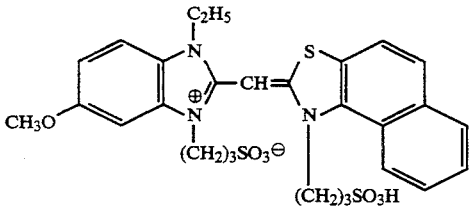
SPS-I-20
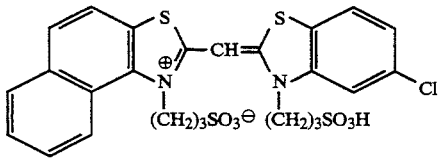
SPS-II-1
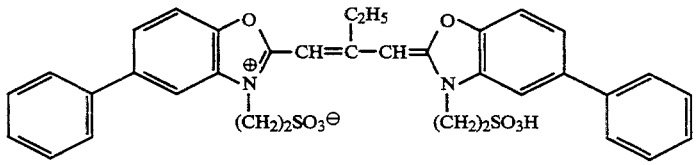

-continued
SPS-II-2
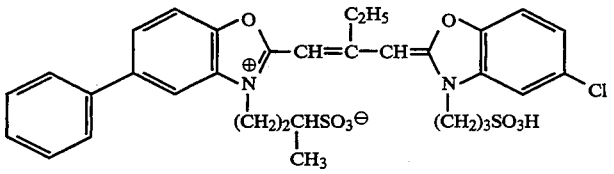
SPS-II-3
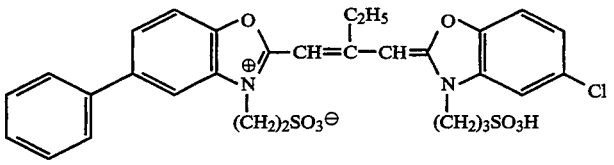
SPS-II-4
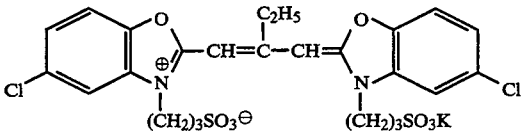
SPS-II-5
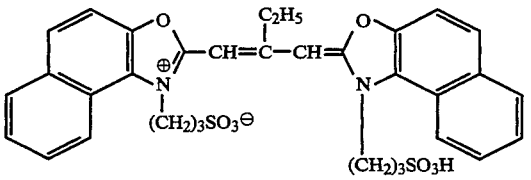
SPS-II-6
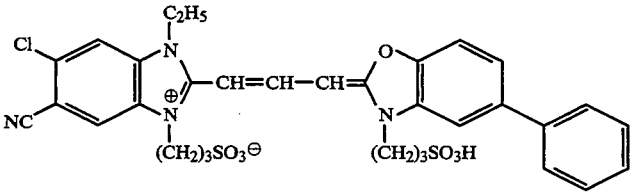
SPS-II-7
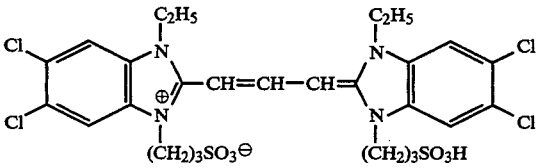
SPS-II-8
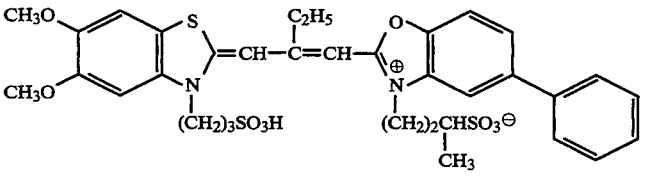
SPS-II-9
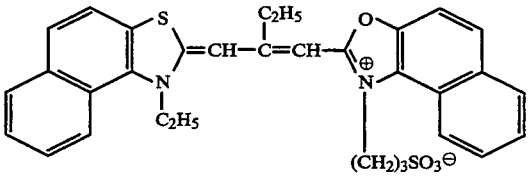
SPS-II-10
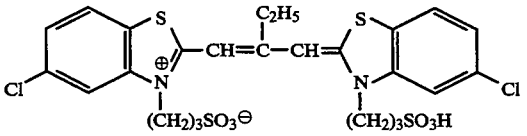

-continued
SPS-II-11
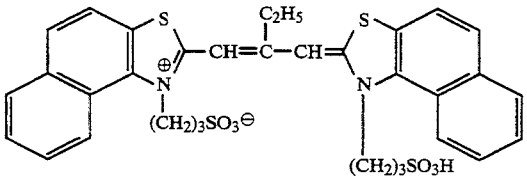
SPS-II-12
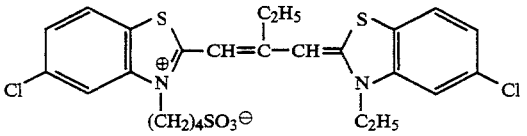
SPS-II-13
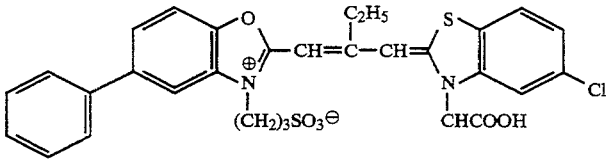
SPS-II-14
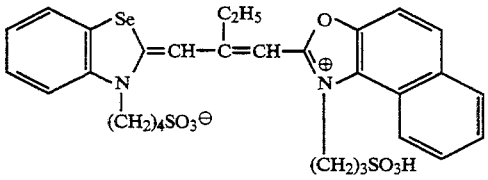
SPS-II-15
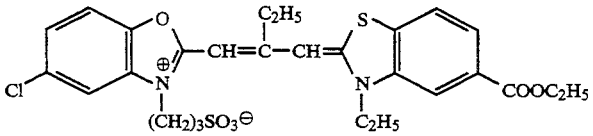
SPS-II-16
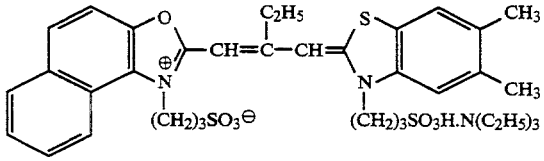
SPS-II-17
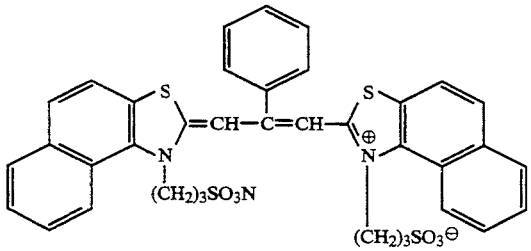
SPS-II-18
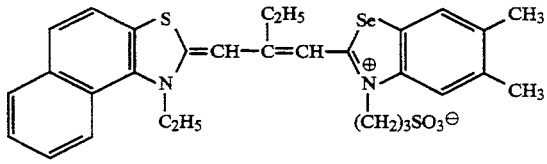
SPS-II-19
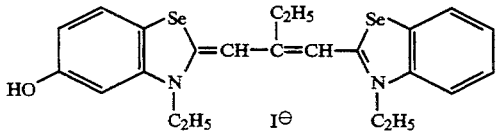

-continued
SPS-III-1
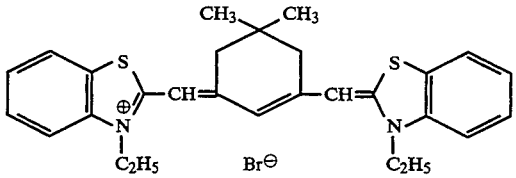
SPS-III-2
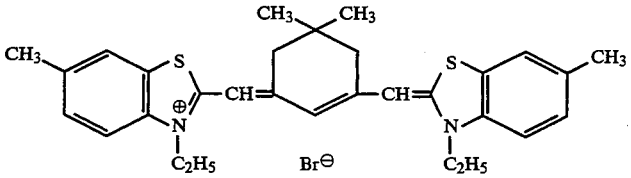
SPS-III-3
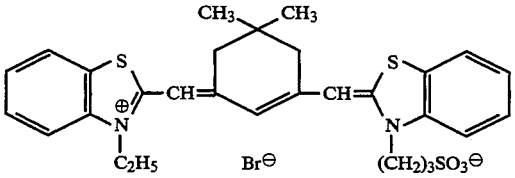
SPS-III-4
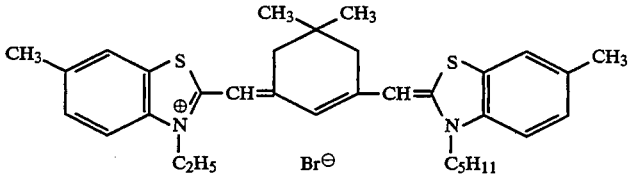
SPS-III-5
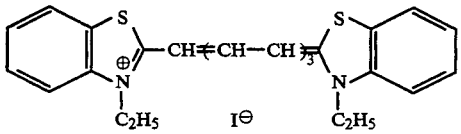
SPS-III-6
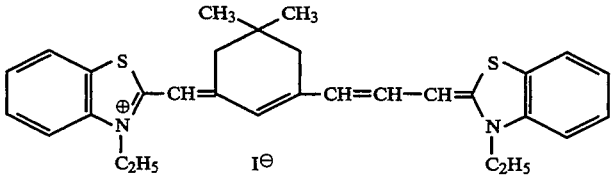
SPS-III-7
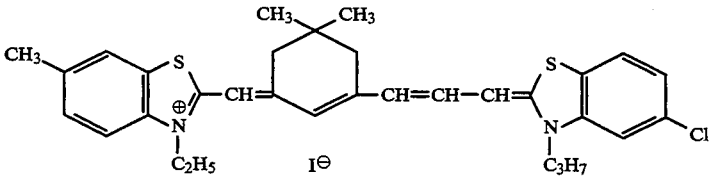
SPS-III-8
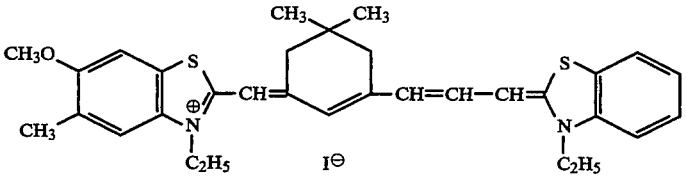
SPS-III-9
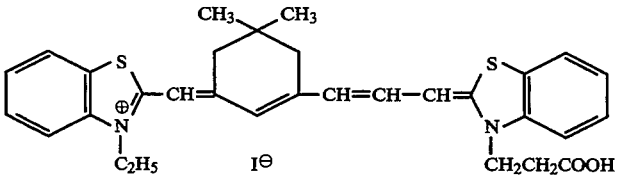

-continued

SPS-III-10

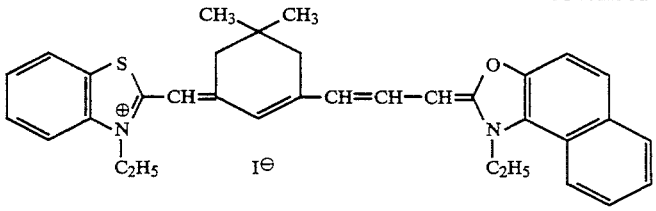

SPS-III-11

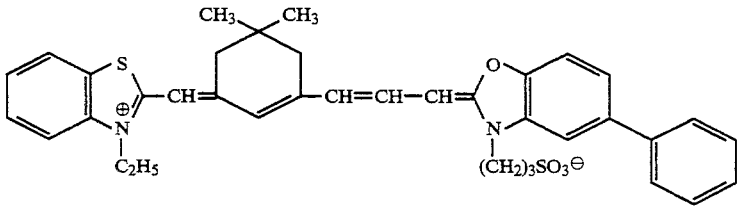

SPS-III-12

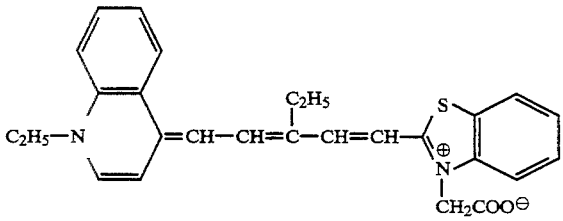

SPS-III-13

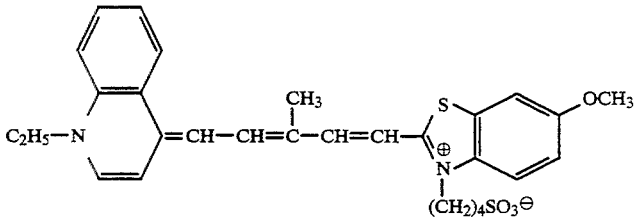

SPS-III-14

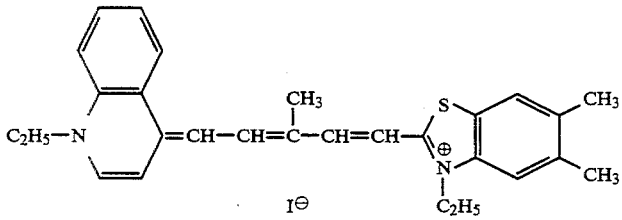

SPS-III-15

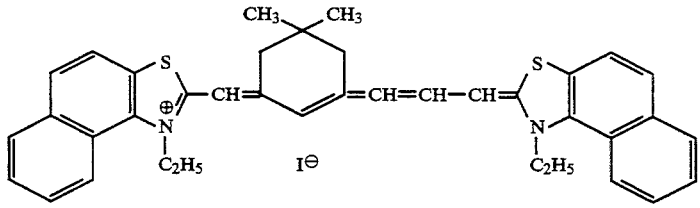

The silver halide photographic emulsion according to the present invention is characterized by having been spectrally sensitized in the presence of a solid dispersion of the spectral sensitizer under conditions that the weight ratio of silver to gelatin (Ag/Gel) is from 2 to 8.5. Spectral sensitization carried out under conditions of (Ag/Gel)<2 makes it difficult to obtain the effect of the present invention. Under conditions of (Ag/Gel)>8, fog tends to occur undesirably. The weight ratio of silver to gelatin may more preferably be from 3 to 8, and most preferably from 3.5 to 7.5. The ratio of silver to gelatin can be adjusted, for example, by controlling the amount of gelatin to be added to the emulsion after desalting process of the emulsion.

As couplers used in the light-sensitive silver halide photographic material according to the present invention, any compounds can be used so long as they are capable of coupling with an oxidized product of a color developing agent to form coupling products having a spectral absorption maximum wavelength in a wavelength region longer than 340 nm. Particularly typical compounds are those known as yellow couplers having a spectral absorption maximum wavelength in a wavelength region of from 350 to 500 nm, magenta couplers having a spectral absorption maximum wavelength in a wavelength region of from 500 to 600 nm, and cyan couplers having a spectral absorption maximum wavelength in a wavelength region of from 600 to 750 nm.

Cyan couplers preferably usable in the light-sensitive silver halide photographic material according to the present invention may include couplers represented by Formulas C-I and C-II disclosed in Japanese Patent O.P.I. Publication No. 114152/1992, page 17. Specific compounds may include those disclosed as CC-1 to CC-9 in the same publication, pages 18–21. Magenta couplers preferably usable in the light-sensitive silver halide photographic material according to the present invention may include couplers represented by Formula M-I disclosed in Japanese Patent O.P.I. Publication No. 114152/1992, page 12. Specific compounds may include those disclosed as MC-1 to MC-7 in the same publication, pages 13–16.

Yellow couplers preferably usable in the light-sensitive silver halide photographic material according to the present invention may include couplers represented by Formula Y-I disclosed in Japanese Patent O.P.I. Publication No. 114152/1992, page 8. Specific compounds may include those disclosed as YC-1 to YC-9 in the same publication, pages 9–11. In particular, YC-8 and YC-9 disclosed in the same publication, page 11, are preferred since they can reproduce yellow with a desirable color tone.

When the O/W emulsion dispersion process is used to add the coupler used in the light-sensitive silver halide photographic material according to the present invention, the coupler is usually dissolved in a water-insoluble high-boiling organic solvent with a boiling point of 150° C. or above optionally together with a low-boiling and/or water-soluble organic solvent and emulsifyingly dispersed in a hydrophilic binder such as an aqueous gelatin solution by the use of a surface active agent. As a dispersion means, it is possible to use a stirrer, a homogenizer, a colloid mill, a flow jet mixer, an ultrasonic dispersion machine or the like. After dispersion, or at the same time with the dispersion, the step of removing the low-boiling organic solvent may be inserted. As the high-boiling organic solvent that can be used to dissolve the coupler to effect dispersion, phthalates such as dioctyl phthalate or phosphates such as tricresyl phosphate may preferably be used.

In place of the method in which the high-boiling organic solvent is used, it is also possible to use a method in which the coupler and a polymer compound insoluble in water and soluble in organic solvent are optionally dissolved in a low-boiling and/or water-soluble organic solvent and emulsifyingly dispersed by means of a dispersion means of various types in a hydrophilic binder such as an aqueous gelatin solution by the use of a surface active agent. The polymer compound insoluble in water and soluble in organic solvent, used here, may include poly(N-t-butyl acrylamide).

For the purpose of shifting absorption wavelength of color forming dyes, compound d-11 disclosed in Japanese Patent O.P.I. Publication No. 114152/1992, page 33, and compound A'-I disclosed in the same publication, page 35, can be used. Besides, it is possible to use fluorescent dye releasing compounds disclosed in U.S. Pat. No. 4,774,187.

In the light-sensitive silver halide photographic material according to the present invention, it is advantageous to use gelatin as a binder. Other gelatin, gelatin derivatives, graft polymers of gelatin with other macromolecules, and hydrophilic colloids such as proteins other than gelatin, sugar derivatives, cellulose derivatives, and hydrophilic colloids of synthetic hydrophilic polymeric substances such as homo- or copolymers may also optionally be used.

Supports used in the light-sensitive silver halide photographic material according to the present invention may be made of any materials, and white pigment-containing polyethylene coated paper, baryta paper, vinyl chloride sheets, polypropylene containing a white pigment, or polyethylene terephthalate supports may be used. In particular, preferred is a support having on its surface a polyolefin resin layer containing a white pigment.

As the white pigment used in a reflective support, inorganic and/or organic white pigments may be used, and an inorganic white pigment is preferably used. For example, it may include alkaline earth metal sulfates such as barium sulfate, alkaline earth metal carbonates such as calcium carbonate, silicas such as finely divided silicate and synthetic silicates, calcium silicate, alumina, alumina hydrates, titanium oxide, zinc oxide, talc and clay. The white pigment preferably includes barium sulfate and titanium oxide.

The white pigment, which is contained in a water-resistant resin layer of the reflective support, may preferably be in an amount of not less than 10% by weight, more preferably not less than 13% by weight, and still more preferably not less than 15% by weight, as a content in the water-resistant resin layer. Degree of dispersion of the white pigment in the water-resistant resin layer of the paper support according to the present invention can be measured by the method disclosed in Japanese Patent O.P.I. Publication No. 28640/1990. As measured using this method, the degree of dispersion of the white pigment in the layer may preferably be 0.20 or less, more preferably 0.15 or less, and still more preferably 0.10 or less, as a coefficient of variation described in that publication.

In the light-sensitive silver halide photographic material according to the present invention, the support may optionally be subjected to corona discharging, ultraviolet irradiation, flame treatment or the like on its surface, and thereafter may be coated with emulsions directly or via an undercoat layer (one or two or more undercoat layers for improving adhesion on the support surface, antistatic properties, dimensional stability, abrasion resistance, hardness, anti-halation properties, frictional characteristics and/or other properties).

When the light-sensitive material is prepared by coating silver halide emulsions, a thickening agent may be used in order to improve coating performance. As coating processes, extrusion coating and curtain coating are particularly useful, which can perform simultaneous coating of two or more layers.

To form photographic images by the use of the light-sensitive silver halide photographic material according to the present invention, an image recorded on a negative film may be optically formed and printed on a printing light-sensitive silver halide photographic material. Alternatively, an image may be once converted into digital information and the image may be formed on a CRT (cathode ray tube), where the resulting image may be formed and printed on a printing light-sensitive silver halide photographic material, or may be printed while scanning with laser light under its intensity varied according to the digital information.

As aromatic primary amine developing agents used in the present invention, any known compounds may be used. Such compounds can be exemplified by the following compounds.

CD-1) N,N-diethyl-p-phenylenediamine
CD-2) 2-Amino-5-diethylaminotoluene
CD-3) 2-Amino-5-(N-ethyl-N-laurylamino)toluene
CD-4) 4-Amino-3-methyl-N-ethyl-N-(β-butoxyethyl-)aniline
CD-5) 2-Methyl-4-[N-ethyl-N-(β-hydroxyethyl-)amino]aniline
CD-6) 4-Amino-3-methyl-N-ethyl-N-[β-methanesulfonamido)ethyl]aniline
CD-7) N-(2-Amino-5-diethylaminophenylethyl)methanesulfonamide
CD-8) N,N-dimethyl-p-phenylenediamine
CD-9) 4-Amino-3-methyl-N-ethyl-N-methoxyethylaniline
CD-10) 4-Amino-3-methyl-N-ethyl-N-(β-ethoxyethyl-)aniline In addition to the above color developing agent, known developing solution component compounds may be added to a color developing solution. Alkali agents having the action of pH buffering, chloride ions, development restrainers such as benzotriazole, preservatives, chelating agents and so forth are usually used.

The light-sensitive silver halide photographic material of the present invention is subjected, after color developing, to bleaching and fixing. The bleaching may be carried out at the same time with the fixing. After the fixing, washing with water is usually carried out. In place of the washing, stabilizing may be carried out. As photographic processing apparatus used in photographic processing of the light-sensitive silver halide photographic material of the present invention, the apparatus may be of a roller transport type in which light-sensitive materials are held between, and transported through, rollers provided in processing tanks, or an endless belt system in which light-sensitive materials are secured to, and transported on, a belt. It is also possible to use a system in which processing tanks are formed in the form of slits, where processing solutions are fed to such processing tanks and at the same time light-sensitive materials are transported therethrough, a system in which processing solutions are sprayed, a web system in which light-sensitive materials are brought into contact with carriers impregnated with processing solutions, and a system in which viscous processing solutions are used.

EXAMPLES

EXAMPLE 1

To both sides of base paper with a basis weight of 180 g/m$^2$, high-density polyethylene was laminated to produce a paper support. To its side on which emulsion layers were to be provided, molten polyethylene containing surface-treated anatase type titanium oxide having been dispersed in a content of 154 by weight was laminated, to produce a reflective support. On this reflective support, layers with the constitution shown below were provided by coating to produce a light-sensitive silver halide photographic material. Coating solutions were prepared in the following way:

To 17.5 g of magenta coupler M-1, 7.5 g each of additives ST-1, ST-2 and ST-3 and 10.0 g of high-boiling organic solvent DNP (dinonyl phthalate), 60 ml of ethyl acetate was added to carry out dissolution. The resulting solution was emulsifyingly dispersed using an ultrasonic homogenizer, in 220 ml of an aqueous 10% gelatin solution containing 15.0 ml of a 15% surface active agent SU-1. Thus a magenta coupler dispersion was prepared.

The resulting dispersion was mixed with a silver halide emulsion (containing 8.50 g of silver) prepared under the conditions described later, to give a first-layer coating solution. A second-layer coating solution was also prepared in the same procedure as the first-layer coating solution. As hardening agents, H-1 was added to the second layer. As coating aids, surface active agents SU-2 and SU-3 were added to make adjustment of surface tension.

Samples 101 to 138 were prepared in the manner as described above. Layer structure was as shown below.

TABLE 1

| Constitution | |
|---|---|
| Layer | Amount (g/m$^2$) |
| Second layer: | 1.50 |
| (Protective layer) | |
| Gelatin | |
| First layer: | |
| (Light-sensitive layer) | |
| Gelatin | 1.40 |
| Silver chlorobromide emulsion | 0.17 |
| Magenta coupler M-1 | 0.35 |
| Image stabilizer ST-1 | 0.15 |
| Image stabilizer ST-2 | 0.15 |
| Image stabilizer ST-3 | 0.15 |
| DNP | 0.20 |

The amount of the silver halide emulsion added is in terms of silver.

(M-1)

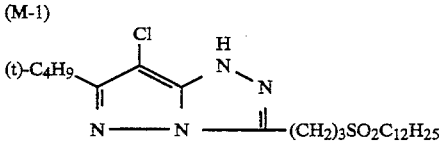

(ST-1)

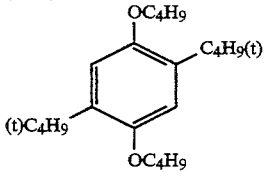

(ST-2)

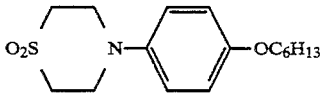

(ST-3)

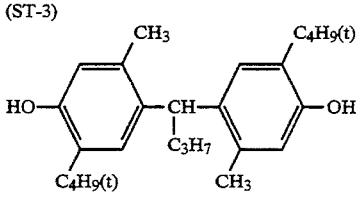

(H-1)
$C(CH_2SO_2CH{=}CH_2)_4$ (SU-1)

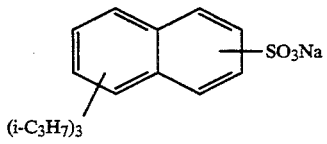

TABLE 1-continued (SU-2)

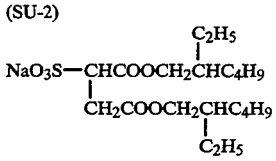

(SU-3)

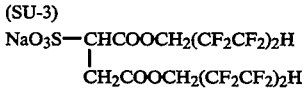

Preparation of silver halide emulsion:

In 1 liter of an aqueous 2% gelatin solution kept at a temperature of 40° C., the following solution A and solution B were simultaneously added while controlling the pAg and pH to be 6.5 and 3.0, respectively, and the following solution C and solution D were further simultaneously added while controlling the pAg and pH to be 7.3 and 5.5, respectively. At this time, the pAg was controlled by the method disclosed in Japanese Patent O.P.I. Publication No. 45437/1984 and the pH was controlled using an aqueous solution of sulfuric acid or sodium hydroxide.

| | |
|---|---|
| Solution A: | |
| Sodium chloride | 3.42 g |
| Potassium bromide | 0.07 g |
| By adding water, made up to | 200 ml |
| Solution B: | |
| Silver nitrate | 10.0 g |
| By adding water, made up to | 200 ml |
| Solution C: | |
| Sodium chloride | 102.7 g |
| Potassium bromide | 2.10 g |
| By adding water, made up to | 600 ml |
| Solution D: | |
| Silver nitrate | 300 g |
| By adding water, made up to | 600 ml |

After completion of the addition, the emulsion was desalted using an aqueous 5% solution of DEMOL-N, produced by Kao Atlas Co, and an aqueous 20% solution of magnesium sulfate, and then mixed with an aqueous gelatin solution to give a monodisperse cubic emulsion EMP-1 having an average grain size of 0.43 μm, a coefficient of variation (S/R) of 0.09 and a silver chloride content of 99.0 mol%. Gelatin content was adjusted to 103.6 g, and (Ag/Gel) was 1.9. The coefficient of variation is defined to be the ratio of standard deviation S to average grain size R.

In the preparation of EMP-1, the amount of the aqueous gelatin solution added after the desalting was adjusted to prepare emulsions having different values of (Ag/Gel).

Silver halide emulsion EMP-2 was prepared in the same manner as in the preparation of EMP-1 except that the amount of the halide salt in the solution A and solution C each was so changed that potassium bromide was in an amount of 3 mol%, and also silver halide emulsion EMP-3 in the same manner except that potassium bromide was in an amount of 7 mol%. In the preparation of these emulsions, like EMP-1, the amount of the aqueous gelatin solution added after the desalting was adjusted to prepare emulsions having different values of (Ag/Gel).

To 980 g of pure water, 20 g of spectral sensitizer SPS-II-1 was added, and the resulting liquid was temperature-conditioned to 40° C., and dispersed at 5,000 rpm over a period of 120 minutes using the high-speed stirring dispersion machine as shown in FIG. 1 in Japanese Patent O.P.I. Publication No. 125631/1992, to obtain a dispersion. Also, 15 g of the spectral sensitizer SPS-II-1 was dissolved in methanol and made up to 10 liter to obtain a methanol solution of the spectral sensitizer.

The respective emulsions were subjected to chemical sensitization at 60° C. using the following compounds. As spectral sensitizers the methanol solution and the solid dispersion were used in the manner of combination as shown in Table 2. Emulsions were thus prepared.

| | |
|---|---|
| Sodium thiosulfate | 1.5 mg/mol · AgX |
| Chloroauric acid | 1.0 mg/mol · AgX |
| Spectral sensitizer SPS-II-1 | 100 mg/mol · AgX |

After the emulsions reached a given temperature, the spectral sensitizers were added. After 90 minutes, sodium thiosulfate was added, and chloroauric acid was added after further 90 minutes. At the time the chemical sensitization was completed, stabilizer STAB-1 was added in an amount of $3\times10^{-4}$ mol/mol·A9X.

STAB-1

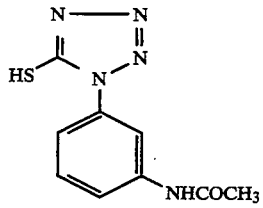

The total amount of gelatin in each emulsion was adjusted to a prescript value before coating so that its coating weight amounts to 1.40 g/m$^2$.

Two sheets of each sample were prepared, one of which was stored in a refrigerator kept at 5° C. and the other of which was left to stand in an environment of 25° C. and 80%RH for 2 days. They were then simultaneously subjected to optical wedge exposure by a conventional method for an exposure time of 0.5 second, and thereafter photographically processed according to the following processing steps.

| Processing steps | Processing temp. | Time |
|---|---|---|
| Color developing | 35.0 ± 0.3° C. | 45 sec. |
| Bleach-fixing | 35.0 ± 0.3° C. | 45 sec. |
| Stabilizing | 30 to 34° C. | 90 sec. |

Processing solutions each had the composition shown below.

| | |
|---|---|
| Color developing solution | |
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenetriaminetetraacetic acid | 1.0 g |
| Disodium catechol-3,5-diphosphonate | 1.0 g |
| N-ethyl-N-(β-methanesulfonamidoethyl)-3-methyl-4-aminoaniline sulfate | 4.5 g |
| Fluorescent brightener | 1.0 g |

-continued

| | |
|---|---|
| (4,4'-diaminostilbenesulfonic acid derivative) | |
| Potassium carbonate | 27 g |
| Made up to 1 liter in total by adding water, and adjusted to pH 10.6. | |
| Bleach-fixing solution | |
| Ferric ammonium ethylenediaminetetraacetate dihydrate | 60 g |
| Ethylenediaminetetraacetic acid | 3 g |
| Ammonium thiosulfate (aqueous 70% solution) | 100 ml |
| Ammonium sulfite (aqueous 40% solution) | 27.5 ml |
| Made up to 1 liter in total by adding water, and adjusted to pH 5.7 using potassium carbonate or glacial acetic acid. | |
| Stabilizing solution | |
| 5-Chloro-2-methyl-4-isothiazolin-3-one | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (aqueous 20% solution) | 3.0 g |
| Fluorescent brightener (4,4'-diaminostilbenesulfonic acid derivative) | 1.5 g |
| Made up to 1 liter in total by adding water, and adjusted to pH 7.0 using sulfuric acid or potassium hydroxide. | |

Green densities of magenta dye images obtained were measured using a densitomiter PDA-65 (manufactured by Konica Corporation) to obtain characteristic curves. Sensitivities were measured as reciprocals of the amount of exposure that gave a density 0.75. Sensitivities of the samples having been stored in a refrigerator were indicated as relative values assuming the sensitivity of sample 101 as 100, and those of the samples having been stored in an environment of 25° C. and 80%RH, as relative values assuming the sensitivity of each sample having been stored in a refrigerator, as 100.

Results obtained are shown in Table 2.

TABLE 2

| Sample No. | AgBr content | Spectral sensitizer | (Ag/Gel) | Regfrigerator Sensitivity | Regfrigerator Fog | * Sensitivity | ** |
|---|---|---|---|---|---|---|---|
| 101 | 1 mol % | MeOH solution | 1.9 | 100 | 0.02 | 72 | X |
| 102 | 1 mol % | MeOH solution | 2.5 | 103 | 0.02 | 73 | X |
| 103 | 1 mol % | MeOH solution | 3.3 | 101 | 0.02 | 75 | X |
| 104 | 1 mol % | MeOH solution | 4.5 | 100 | 0.02 | 75 | X |
| 105 | 1 mol % | MeOH solution | 7.0 | 98 | 0.03 | 73 | X |
| 106 | 1 mol % | MeOH solution | 8.7 | 95 | 0.05 | 70 | X |
| 107 | 1 mol % | Solid dispersion | 1.9 | 98 | 0.02 | 74 | X |
| 108 | 1 mol % | Solid dispersion | 2.5 | 101 | 0.02 | 93 | Y |
| 109 | 1 mol % | Solid dispersion | 3.3 | 98 | 0.02 | 95 | Y |
| 110 | 1 mol % | Solid dispersion | 4.5 | 98 | 0.02 | 97 | Y |
| 111 | 1 mol % | Solid dispersion | 7.0 | 97 | 0.02 | 95 | Y |
| 112 | 1 mol % | Solid dispersion | 8.7 | 96 | 0.04 | 92 | X |
| 113 | 3 mol % | MeOH solution | 1.9 | 103 | 0.03 | 75 | X |
| 114 | 3 mol % | MeOH solution | 2.5 | 102 | 0.02 | 78 | X |
| 115 | 3 mol % | MeOH solution | 3.3 | 103 | 0.02 | 78 | X |
| 116 | 3 mol % | MeOH solution | 4.5 | 102 | 0.03 | 78 | X |
| 117 | 3 mol % | MeOH solution | 7.0 | 100 | 0.04 | 73 | X |
| 118 | 3 mol % | MeOH solution | 8.7 | 99 | 0.06 | 73 | X |
| 119 | 3 mol % | Solid dispersion | 1.9 | 102 | 0.02 | 79 | X |
| 120 | 3 mol % | Solid dispersion | 2.5 | 100 | 0.02 | 92 | Y |
| 121 | 3 mol % | Solid dispersion | 3.3 | 101 | 0.02 | 94 | Y |
| 122 | 3 mol % | Solid dispersion | 4.5 | 102 | 0.02 | 96 | Y |
| 123 | 3 mol % | Solid dispersion | 7.0 | 100 | 0.03 | 93 | Y |
| 124 | 3 mol % | Solid dispersion | 8.7 | 98 | 0.05 | 91 | X |
| 125 | 7 mol % | MeOH solution | 1.9 | 105 | 0.04 | 84 | X |
| 126 | 7 mol % | MeOH solution | 2.5 | 107 | 0.05 | 86 | X |
| 127 | 7 mol % | MeOH solution | 3.3 | 106 | 0.05 | 87 | X |
| 128 | 7 mol % | MeOH solution | 4.5 | 103 | 0.06 | 85 | X |
| 129 | 7 mol % | MeOH solution | 7.0 | 101 | 0.07 | 87 | X |
| 130 | 7 mol % | MeOH solution | 8.7 | 98 | 0.10 | 85 | X |
| 131 | 7 mol % | Solid dispersion | 1.9 | 102 | 0.04 | 85 | X |
| 132 | 7 mol % | Solid dispersion | 2.5 | 103 | 0.04 | 86 | X |
| 133 | 7 mol % | Solid dispersion | 3.3 | 104 | 0.05 | 86 | X |
| 134 | 7 mol % | Solid dispersion | 4.5 | 100 | 0.06 | 88 | X |
| 135 | 7 mol % | Solid dispersion | 7.0 | 100 | 0.06 | 85 | X |
| 136 | 7 mol % | Solid dispersion | 8.7 | 98 | 0.09 | 83 | X |

* High humidity; ** Remarks
X: Comparative Example; Y: Present Invention

In the case when the solid dispersion of the spectral sensitizer is used, silver halide emulsions containing only 1 mol% or 3 mol% of silver bromide are seen to cause a little lower fog and have substantially the same sensitivity in respect of the samples having been stored in a refrigerator, compared with the case when the methanol solution is used. However, in respect of the samples having been stored in an environment of 25° C. and 80%RH, the samples are stable in the case when the solid dispersion of the spectral sensitizer is used, but on the other hand show a great lowering of sensitivity in the case when the methanol solution is used. The degree of desensitization in the case when the methanol solution is used is greater in the emulsions having a smaller silver bromide content, but no difference is seen in this regard in the case when the solid dispersion of the spectral sensitizer is used, rather resulting in a decrease in desensitization in many instances.

In samples 101, 107, 113, 119, 125 and 131, having smaller (Ag/Gel) values of the silver halide emulsions at the time of spectral sensitization, the improvement in storage stability as aimed in the present invention can not be effective. In samples 106, 112, 118, 124, 130 and 136, having larger (Ag/Gel) values, an increase in fog is clearly seen.

The samples having a silver bromide content of 7 mol% are seen to cause a high fog both in the samples making use of the methanol solution and in the samples making use of the solid dispersion. Compared with the samples having a smaller silver bromide content, even the samples making use of the methanol solution shows a smaller desensitization in the environment of high humidity, but the effect of preventing desensitization is small even when the solid dispersion is used. This phenomenon of deterioration of storage stability is a phenomenon peculiar to the emulsions containing silver chloride in a high content. It will be understood that this disadvantage can be eliminated by the present invention.

EXAMPLE 2

EMP-4 was prepared in the same manner as in the preparation of EMP-1 in Example 1 except that exemplary heavy metal compound (6) was added to solution C in an amount of $1.0\times10^{-8}$ mol/mol·AgX. Similarly, EMP-5 was prepared in the same manner except that an aqueous solution of exemplary heavy metal compound (6) was added in an amount of $5.0\times10^{-8}$ mol/mol·AgX while solution C and solution D were simultaneously added.

The gelatin content was adjusted so that (Ag/Gel) came to be 2.5. The resulting emulsions were each chemically and spectrally sensitized in the same manner as in Example 1. A coated sample was thus produced. Two sheets of each sample were prepared, one of which was stored in a refrigerator and the other of which was stored in an environment of 25° C. and 80%RH for 2 days. They were then exposed and photographically processed. To show the results in Table 3, any changes in sensitivity as a result of storage are indicated as relative values assuming the sensitivity of each sample having been stored in a refrigerator, as 100.

TABLE 3

| Sample No. | Emulsion No. | Spectral sensitizer | Sensitivity after storage | Remarks |
|---|---|---|---|---|
| 102 | EMP-1 | MeOH solution | 73 | X |
| 108 | EMP-1 | Solid dispersion | 93 | Y |
| 201 | EMP-4 | MeOH solution | 70 | X |
| 202 | EMP-4 | Solid dispersion | 96 | Y |
| 203 | EMP-5 | MeOH solution | 71 | X |
| 204 | EMP-5 | Solid dispersion | 94 | Y |

X: Comparative Example; Y: Present Invention

In the methanol solution system, all the silver halide emulsions are seen to have caused desensitization in the samples having been stored in the environment of 25° C. and 80%RH, but have caused desensitization at a smaller degree in the samples making use of the solid dispersion of the spectral sensitizer. In particular, superior characterists are obtained in sample 202 containing exemplary heavy metal compound (6) added together with the halide salt.

EXAMPLE 3

Using EMP-4 of Example 2, a silver halide emulsion was prepared in the same manner except that the additives for the chemical ripening were changed as shown below and the ripening time was changed.

| | |
|---|---|
| Reduction sensitization using thiourea dioxide | |
| Sodium thiosulfate | 1.8 mg/mol · AgX |
| Thiourea dioxide | 0.3 mg/mol · AgX |
| Stabilizer STAB-1 | $6\times10^{-4}$ mol/mol · AgX |
| Spectral sensitizer SPS-II-1 | $1\times10^{-4}$ mol/mol · AgX |
| Reduction sensitization using L-ascorbic acid | |
| Sodium thiosulfate | 1.8 mg/mol · AgX |
| L-ascorbic acid | 0.3 mg/mol · AgX |
| Stabilizer STAB-1 | $6\times10^{-4}$ mol/mol · AgX |
| Spectral sensitizer SPS-II-1 | $1\times10^{-4}$ mol/mol · AgX |

Samples 301 to 306 were prepared in the same manner as in Example 1, and any variations in sensitivity as a result of storage were evaluated.

TABLE 4

| Sample No. | Reduction sensitizer | Spectral sensitizer | Sensitivity after storage | Remarks |
|---|---|---|---|---|
| 201 | — | MeOH solution | 70 | X |
| 202 | — | Solid dispersion | 96 | Y |
| 301 | Thiourea dioxide | MeOH solution | 75 | X |
| 302 | Thiourea dioxide | Solid dispersion | 100 | Y |
| 303 | L-ascorbic acid | MeOH solution | 73 | X |
| 304 | L-ascorbic acid | Solid dispersion | 99 | Y |

X: Comparative Example; Y: Present Invention

Emulsions sensitized by any methods have no great difference in performance in the case when the spectral sensitizer is used in the form of the methanol solution, but in the case when the solid-dispersed spectral sensitizer is used the spectrally sensitized emulsions are improved to undergo a smaller variation in sensitivity. Thus, it is a preferred embodiment to use the spectral sensitizer in combination.

EXAMPLE 4

A silver halide emulsion was prepared in the same manner as EMP-2, and Samples 401 to 418 were prepared in the same manner as in Example 1 except that the type of the spectral sensitizer was changed. Storage stability was evaluated in the same manner as in Example 1 to obtain the results as shown below.

TABLE 5

| Sample No. | Spectral sensitizer | | Sensitivity after storage | Remarks |
|---|---|---|---|---|
| 201 | MeOH solution | SPS-II-1 | 70 | X |
| 202 | Solid dispersion | SPS-II-1 | 96 | Y |
| 401 | MeOH solution | SPS-II-3 | 72 | X |
| 402 | Solid dispersion | SPS-II-3 | 94 | Y |
| 403 | MeOH solution | SPS-II-4 | 75 | X |
| 404 | Solid dispersion | SPS-II-4 | 97 | Y |
| 405 | MeOH solution | SPS-II-11 | 70 | X |
| 406 | Solid dispersion | SPS-II-11 | 94 | Y |
| 407 | MeOH solution | SPS-II-17 | 69 | X |
| 408 | Solid dispersion | SPS-II-17 | 93 | Y |
| 409 | MeOH solution | SPS-II-18 | 65 | X |
| 410 | Solid dispersion | SPS-II-18 | 96 | Y |
| 411 | MeOH solution | SPS-I-3 | 82 | X |
| 412 | Solid dispersion | SPS-I-3 | 96 | Y |
| 413 | MeOH solution | SPS-I-11 | 80 | X |
| 414 | Solid dispersion | SPS-I-11 | 93 | Y |
| 415 | MeOH solution | SPS-I-20 | 82 | X |
| 416 | Solid dispersion | SPS-I-20 | 95 | Y |
| 417 | MeOH solution | SPS-III-I | 63 | X |
| 418 | Solid dispersion | SPS-III-I | 89 | Y |

X: Comparative Example; Y: Present Invention

The effect of the present invention is seen to be obtainable without regard to the type of the spectral sensitizer. In particular, the desensitization in the case of the methanol solution is greater when carbocyanine dyes such as spectral sensitizers SPS-II-1, SPS-II-3 and SPS-II-11 and a dicarbocyanine dye such as SPS-III-1 are used than when simple cyanine dyes such as spectral sensitizers SPS-I-3, SPS-I-11 and SPS-I-20 are used. This disadvantage, however, can be overcome by the effect of the present invention. The present invention is more effective on long-wavelength sensitizing dyes such as carbocyanine dyes and dicarbocyanine dyes.

EXAMPLE 5

To both sides of base paper with a basis weight of 180 g/m$^2$ high-density polyethylene was laminated to produce a paper support. To its side on which emulsion layers were to be provided, molten polyethylene containing surface-treated anatase type titanium oxide having been dispersed in a content of 154 by weight was laminated, to produce a reflective support. On this reflective support, layers with the constitution shown below were provided by coating to produce a multilayer light-sensitive silver halide photographic material, sample 501. Coating solutions were prepared in the following way:

To 26.7 g of yellow coupler Y-1, 10.0 g of dye image stabilizer ST-1, 6.67 g of dye image stabilizer ST-5, 0.67 g of additive HQ-1 and 6.67 g of high-boiling organic solvent DNP, 60 ml of ethyl acetate was added to carry out dissolution. The resulting solution was emulsifyingly dispersed using an ultrasonic homogenizer, in 220 ml of an aqueous 10% gelatin solution containing 9.5 ml of a surface active agent SU-1. Thus a yellow coupler dispersion was prepared. This dispersion was mixed with a blue-sensitive silver halide emulsion (containing 8.68 g of silver) prepared under the conditions described later, to give a first-layer coating solution. Second-layer to seventh-layer coating solutions were also prepared in the similar procedure as the first-layer coating solution. As hardening agents, H-1 was added to the second layer and H-2 to the seventh layer. As coating aids, surface active agents SU-2 and SU-3 were added to make adjustment of surface tension.

Layer structure was as shown below.

TABLE 6

| Constitution | |
|---|---|
| Layer | Amount (g/m$^2$) |
| Seventh layer: (Protective layer) | |
| Gelatin | 1.00 |
| Antifungal agent F-1 | 0.002 |
| Sixth layer: (Ultraviolet absorbing layer) | |
| Gelatin | 0.40 |
| Ultraviolet absorbent UV-1 | 0.10 |
| Ultraviolet absorbent UV-2 | 0.04 |
| Ultraviolet absorbent UV-3 | 0.16 |
| Anti-stain agent HQ-1 | 0.01 |
| DNP | 0.20 |
| PVP | 0.03 |
| Anti-irradiation dye (as shown in Table 7) | 0.02 |
| Fifth layer: (Red-sensitive layer) | |
| Gelatin | 1.30 |
| Red-sensitive silver chlorobromide emulsion Em-R1 | 0.21 |
| Cyan coupler C-1 | 0.17 |
| Cyan coupler C-2 | 0.25 |
| Dye image stabilizer ST-4 | 0.20 |
| Anti-stain agent HQ-1 | 0.01 |
| DOP | 0.20 |
| Fourth layer: (Ultraviolet absorbing layer) | |
| Gelatin | 0.94 |
| Ultraviolet absorbent UV-1 | 0.28 |
| Ultraviolet absorbent UV-2 | 0.09 |
| Ultraviolet absorbent UV-3 | 0.38 |
| Anti-stain agent HQ-1 | 0.03 |
| DNP | 0.40 |
| Anti-irradiation dye Dye-2 | 0.01 |
| Third layer: (Green-sensitive layer) | |
| Gelatin | 1.40 |
| Green-sensitive silver chlorobromide emulsion Em-G1 | 0.17 |
| Magenta coupler M-1 | 0.35 |
| Dye image stabilizer ST-1 | 0.15 |
| Dye image stabilizer ST-2 | 0.15 |
| Dye image stabilizer ST-3 | 0.15 |
| DNP | 0.20 |
| Second layer: (Intermediate layer) | |
| Gelatin | 1.20 |
| Anti-stain agent HQ-2 | 0.12 |
| DIDP | 0.15 |
| Antifungal agent F-1 | 0.002 |
| Anti-irradiation dye Dye-3 | 0.01 |
| First layer: (Blue-sensitive layer) | |
| Gelatin | 1.20 |
| Blue-sensitive silver chlorobromide emulsion Em-B1 | 0.26 |
| Yellow coupler Y-1 | 0.80 |
| Dye image stabilizer ST-4 | 0.30 |
| Dye image stabilizer ST-5 | 0.20 |
| Anti-stain agent HQ-1 | 0.02 |
| DNP | 0.20 |
| Support: Polyethylene-laminated paper | |

The amount of the silver halide emulsion added is in terms of silver.
(Y-1)

TABLE 6-continued
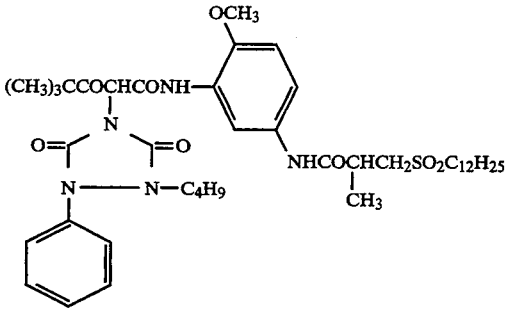
(C-1)
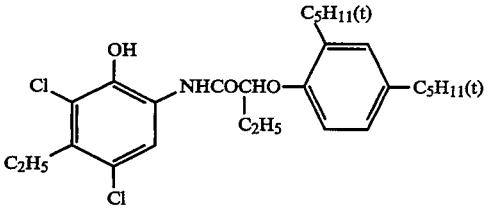
(C-2)
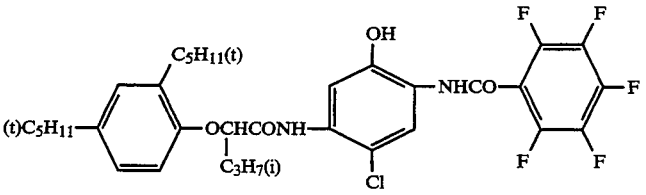
UV-1
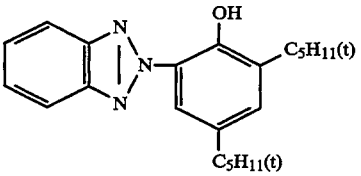
UV-2
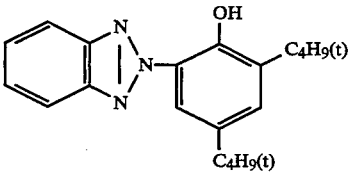
UV-3
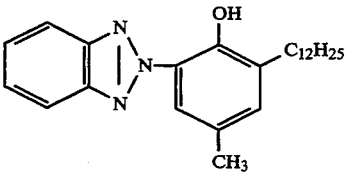
(ST-4)
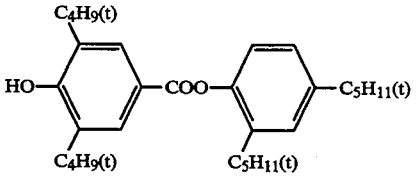
(ST-5)

TABLE 6-continued

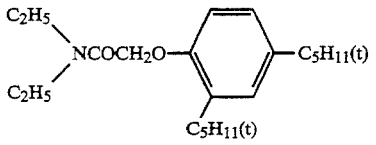

(H-2)

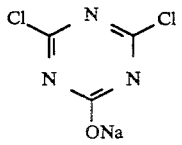

(F-1)

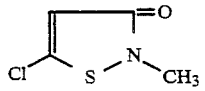

(HQ-1)

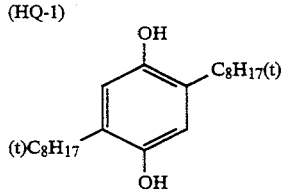

(HQ-2)

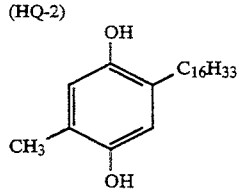

DOP: D-(2-ethylhexyl)-phthalate
DIDP: D-(i-decyl)-phthalate
PVD: Polyvinyl pyrrolidone Preparation of blue-sensitive silver halide emulsion:

In 1 liter of an aqueous 2% gelatin solution kept at a temperature of 40° C., the following solution A and solution B were simultaneously added over a period of 30 minutes while controlling the pAg and pH to be 6.5 and 3.0, respectively, and the following solution C and solution D were further simultaneously added over a period of 180 minutes while controlling the pAg and pH to be 7.3 and 5.5, respectively. At this time, the pAg was controlled by the method disclosed in Japanese Patent O.P.I. Publication No. 45437/1984 and the pH was controlled using an aqueous solution of sulfuric acid sodium hydroxide.

| | |
|---|---|
| Solution A: | |
| Sodium chloride | 3.42 g |
| Potassium bromide | 0.07 g |
| By adding water, made up to | 200 ml |
| Solution B: | |
| Silver nitrate | 10.0 g |
| By adding water, made up to | 200 ml |
| Solution C: | |
| Sodium chloride | 102.7 g |
| Potassium bromide | 2.10 g |
| Exemplary heave metal compound (6) | $1 \times 10^{-8}$ mol |
| By adding water, made up to | 600 ml |
| Solution D: | |
| Silver nitrate | 300 g |

-continued

| | |
|---|---|
| By adding water, made up to | 600 ml |

After completion of the addition, the emulsion was desalted using an aqueous 5% solution of DEMOL-N, produced by Kao Atlas Co, and an aqueous 20% solution of magnesium sulfate, and then mixed with an aqueous gelatin solution to give a monodisperse cubic emulsion EMP-6 having an average grain size of 0.85 μm, a coefficient of variation (S/R) of 0.07 and a silver chloride content of 99.0 mol%.

Preparation of green-sensitive silver halide emulsion:

An emulsion prepared by spectrally sensitizing the silver halide emulsion EMP-4 of Example 1 using a solid dispersion of spectral sensitizer SPS-II-I was used as green-sensitive emulsion Em-G1.

Preparation of red-sensitive silver halide emulsion:

The preparation of EMP-4 in Example 1 was repeated except that the addition time of the solutions A and B and the addition time of the solutions C and D were changed, to give a monodisperse cubic emulsion EMP-7 having an average grain size of 0.50 μm, a coefficient of variation (S/R) of 0.08 and a silver chloride content of 99.0 mol%.

The emulsion EMP-6 was subjected to chemical sensitization at 55° C. for 130 minutes using the following compounds to give a blue-sensitive silver halide emulsion Em-B1. As spectral sensitizers, SPS-I-3 and SPS-I-11 were mixed and formed into a solid dispersion, which was put into use. After the silver halide emulsion reached a given temperature, the spectral sensitizers were added. After 90 minutes, elemental d-sulfur was added, and chloroauric acid was added after further 90 minutes to carry out chemical sensitization.

| | |
|---|---|
| α-Sulfur | 0.15 mg/mol · AgX |
| Chloroauric acid | 0.5 mg/mol · AgX |
| Stabilizer STAB-1 | $6 \times 10^{-4}$ mol/mol · AgX |
| Spectral sensitizer SPS-I-3 | $4 \times 10^{-4}$ mol/mol · AgX |
| Spectral sensitizer SPS-I-11 | $1 \times 10^{-4}$ mol/mol · AgX |

The emulsion EMP-7 was also subjected to chemical sensitization at 60° C. for 120 minutes using the following compounds to give a red-sensitive silver halide emulsion Em-$R_1$. The compounds were added in the same order as in the preparation of the blue-sensitive silver halide emulsion. The spectral sensitizer was used in the form of a solid dispersion.

| | |
|---|---|
| α-Sulfur | 0.2 mg/mol · AgX |
| Chloroauric acid | 2.0 mg/mol · AgX |
| Stabilizer STAB-1 | $6 \times 10^{-4}$ mol/mol · AgX |
| Spectral sensitizer SPS-II-11 | $2 \times 10^{-4}$ mol/mol · AgX |

Subsequently, sample 502 was prepared in the same manner as in the production of the sample 501 except that the solid dispersion of the spectral sensitizer was changed to a methanol solution thereof.

In the preparation of the samples 501 and 502, Dye-1 was replaced with AI-1 to prepare samples 503 and 504, and replaced with AI-9 to prepare samples 505 and 506. Samples made into rolls were packaged with black paper, and left to stand for a day in an environment of 25° C. and 80% RH or stored in a refrigerator for that period. The samples having been thus left or stored were printed using KONICA COLOR GX-400 and using an NPS-602QA printer processor. Results obtained are shown in Table 7.

TABLE 7

| Sample No. | Light-sensitive layer | Anti-irradiation dye | Spectral sensitizer | Sensitivity after storage | Remarks |
|---|---|---|---|---|---|
| 501 | B | Dye-1 | Solid dispersion | 97 | Y |
| | G | | | 93 | |
| | R | | | 95 | |
| 502 | B | Dye-1 | MeOH Solution | 88 | X |
| | G | | | 80 | |
| | R | | | 75 | |
| 503 | B | AI-1 | Solid dispersion | 97 | Y |
| | G | | | 97 | |
| | R | | | 98 | |
| 504 | B | AI-1 | MeOH Solution | 89 | X |
| | G | | | 83 | |
| | R | | | 78 | |
| 505 | B | AI-9 | Solid dispersion | 98 | Y |
| | G | | | 99 | |
| | R | | | 98 | |
| 506 | B | AI-9 | MeOH Solution | 89 | X |
| | G | | | 85 | |
| | R | | | 78 | |

X: Comparative Example; Y: Present Invention

Dye 1

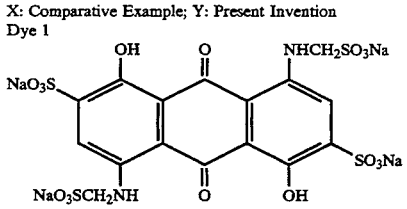

Printing conditions were set in accordance with the samples stored in a refrigerator. Hence, color prints with an excellent image quality were obtained in all the refrigerator-stored samples, but in the samples 502, 504 and 506, the high-humidity stored samples, a density decrease was remarkable on the prints at the initial stage to give reddish prints lost in color balance. As insides of the roll-like light-sensitive materials were put into use, such density variations over the whole images became smaller, but density uneveness was conspicuous at marginal areas of prints of some scenes. This is presumably due to penetration of moisture from the marginal portions of the light-sensitive materials. In a scene of roadways paved with asphalt, edges of the print were reddish in stripes, resulting in a great lowering of image quality of color prints.

On the other hand, the samples 501,503 and 505 cause only a small color variation. In particular, the samples 503 and 505 cause only so small a variation that color prints having almost no difference from those of the refrigerator-stored samples were obtained.

Using the samples 501, 503 and 505, prints were produced by laser exposure.

As image data, those obtained by converting a color slide image (a portrait) with a size of 4×5 inches into digital numerals with a size of 25×25 μm per picture element by means of a scanner were used.

As an exposure apparatus, an optical system was set up using a helium-cadmium laser (about 442 nm) as a blue light source, a helium-neon laser (about 544 nm) as a green light source and a helium-neon laser (about 633 nm) as a red light source. The light rays emitted from the three lasers were modulated according to the image data and thereafter focused into a line of beam, to which a light-sensitive silver halide photographic material transported at a speed of 20 mm/sec was scanning-exposed at a main scanning speed of 160 m/sec. at right angles to the direction of transport. At this time the beam size was about 80 μm, and the exposure time per picture element was 500 nanoseconds.

It was possible to obtain excellent images by using the light-sensitive silver halide photographic material according to the present invention, also in an image forming apparatus making use of such laser exposure.

As described above, the present invention enables prevention of the variations in sensitivity of silver halide photographic emulsions that may be caused by storage in an environment of room temperature and high humidity, and has made it possible to provide a silver halide photographic emulsion causing less performance changes with time. The light-sensitive silver halide photographic material obtained using this emulsion makes it possible to stably provide color prints with a high quality.

What is claimed is:

1. A silver halide photographic light-sensitive material comprising a support having thereon a silver halide emulsion layer, wherein said silver halide emulsion comprises silver chlorobromide grains having a silver chloride content of not less than 95 mol % and gelatin, and being optically sensitized by addition of a dispersion of an optical sensitizer comprising an aqueous medium and particles of said sensitizer dispersed in the medium, and said emulsion has a ratio of silver to gelatin (Ag/Gel) of 2 to 8.5 at the time of the addition of said dispersion of the sensitizer.

2. The light-sensitive material of claim 1, wherein said optical sensitizer is one represented by Formula SPS-I, SPS-II or SPS-III;

(SPS-I)

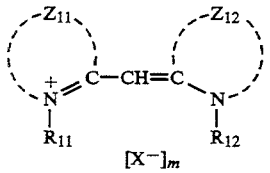

wherein $Z_{11}$ and $Z_{12}$ are each a group of atoms necessary to complete a nucleus of oxazole, thiazole, selenazole, pyridine, benzoxazole, benzothiazole, benzoselenazole, benzimidazole, naphthoxazole, naphthothiazole, naphthoselanazole, naphthimidazole or quinoline; $R_{11}$ and $R_{12}$ are each an alkyl group, an alkenyl group or an aryl group; $X^-$ an anion; and m is zero or 1, (SPS-II)

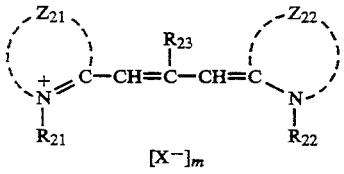

wherein $Z_{21}$ and $Z_{22}$ are each a group of atoms necessary to complete a nucleus of oxazole, thiazole, selenazole, pyridine, benzoxazole, benzothiazole, benzoselenazole, benzimidazole, naphthoxazole, naphthothiazole, naphthoselenazole, naphthimidazole or quinoline; $R_{21}$ and $R_{22}$ are the same as $R_{11}$ and $R_{12}$ defined in Formula SPS-I; and $X^-$ and m are the same as $X^-$ and m in Formula SPS-I, respectively, (SPS-III)

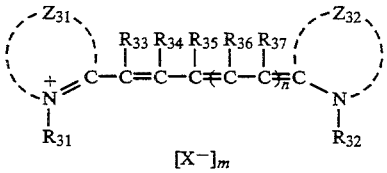

wherein $Z_{31}$ and $Z_{32}$ are each a group of atoms necessary to complete a nucleus of benzoxazole, benzothiazole, benzoselenazole, naphthoxazole, naphthothiazole, naphthoselenazole or quinoline; $R_{31}$ and $R_{32}$ are the same as $R_{11}$ and $R_{12}$ defined in Formula SPS-I; and $X^-$ and m are the same as $X^-$ and m in Formula SPS-I, respectively.

3. The light-sensitive material of claim 2, wherein said optical sensitizing dye is one represented by Formula SPS-II or SPS-III.

4. The light-sensitive material of claim 1, wherein said weight ratio of silver to gelatin is within the range of from 3.0 to 8.0.

5. The light-sensitive material of claim 4, wherein said weight ratio of silver to gelatin is within the range of from 3.5 to 7.5.

6. The light-sensitive material of claim t, wherein said emulsion layer or another layer provided on the surface of the support on which said emulsion layer is provided contains a compound represented by the following Formula AI;

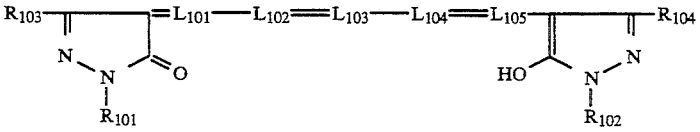

wherein $L_{101}$, $L_{102}$, $L_{103}$, $L_{104}$, and $L_{105}$ are each a methine group; $R_{101}$ and $R_{102}$ are each an aralkyl group, an aryl group or a heterocyclic group; and $R_{103}$ and $R_{104}$ are each a mono-valent organic group.

7. The light-sensitive material of claim 1, wherein silver halide grains contains an ion of iron, iridium, platinum, ruthenium or osmium.

8. The light-sensitive material of claim 1, wherein said emulsion is chemically sensitized with a reducing agent.

* * * * *